US008584748B2

(12) United States Patent
Church et al.

(10) Patent No.: US 8,584,748 B2
(45) Date of Patent: Nov. 19, 2013

(54) ELONGATED PROBE FOR DOWNHOLE TOOL

(75) Inventors: Nathan Church, Missouri City, TX (US); Stephane Briquet, Houston, TX (US); Darya Mustafina, Moscow (RU); Alexander Skibin, Moscow (RU); Alexander Zazovsky, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 358 days.

(21) Appl. No.: 12/831,573

(22) Filed: Jul. 7, 2010

(65) Prior Publication Data

US 2011/0162836 A1 Jul. 7, 2011

Related U.S. Application Data

(60) Provisional application No. 61/225,338, filed on Jul. 14, 2009.

(51) Int. Cl.
*E21B 49/08* (2006.01)

(52) U.S. Cl.
USPC .... 166/264; 166/250.17; 166/187; 73/152.26

(58) Field of Classification Search
USPC ..... 166/264, 250.17, 100, 187; 73/152.26
See application file for complete search history.

(56) References Cited

U.S. PATENT DOCUMENTS

| | | | | |
|---|---|---|---|---|
| 4,860,581 | A | 8/1989 | Zimmerman et al. | |
| 4,936,139 | A | 6/1990 | Zimmerman et al. | |
| 5,549,159 | A * | 8/1996 | Shwe et al. | 166/250.17 |
| 6,192,982 | B1 * | 2/2001 | Divis et al. | 166/187 |
| 6,729,399 | B2 * | 5/2004 | Follini et al. | 166/264 |
| 6,986,282 | B2 | 1/2006 | Ciglenec et al. | |
| 7,114,562 | B2 | 10/2006 | Fisseler et al. | |
| 7,128,144 | B2 * | 10/2006 | Fox et al. | 166/264 |
| 7,458,419 | B2 | 12/2008 | Nold, III et al. | |
| 7,584,655 | B2 * | 9/2009 | van Zuilekom et al. | 166/100 |
| 7,650,937 | B2 * | 1/2010 | Fox et al. | 166/264 |
| 7,654,321 | B2 * | 2/2010 | Zazovsky et al. | 166/264 |
| 7,779,684 | B2 * | 8/2010 | Meek et al. | 73/152.24 |
| 7,841,406 | B2 * | 11/2010 | Zazovsky et al. | 166/264 |
| 8,015,867 | B2 * | 9/2011 | Kerr et al. | 73/152.26 |
| 8,235,106 | B2 * | 8/2012 | Fox et al. | 166/100 |
| 2002/0062992 | A1 * | 5/2002 | Fredericks et al. | 175/40 |
| 2003/0098156 | A1 * | 5/2003 | Follini et al. | 166/264 |
| 2008/0295588 | A1 * | 12/2008 | van Zuilekom et al. | 73/152.26 |
| 2010/0083748 | A1 * | 4/2010 | Kerr et al. | 73/152.26 |

* cited by examiner

*Primary Examiner* — Frederick L Lagman
(74) *Attorney, Agent, or Firm* — John Vereb

(57) ABSTRACT

An apparatus comprising a tool body configured to be conveyed within a wellbore extending into a subterranean formation, an inflatable packer coupled to the tool body, and a probe assembly coupled to the tool body and comprising an inner sealing element and an outer sealing element, wherein at least one of the inner sealing element and the outer sealing element comprises an elongated shape, and wherein at least a portion of the probe assembly is disposed on the inflatable packer.

19 Claims, 16 Drawing Sheets

ELONGATED PROBE FOR DOWNHOLE TOOL

CROSS-REFERENCE TO PRIORITY APPLICATION

The present application claims the benefit of, and priority to, U.S. Provisional Patent Application No. 61/225,338, filed Jul. 14, 2009, the entirety of which is hereby incorporated herein by reference.

BACKGROUND OF THE DISCLOSURE

Wellbores are drilled into the Earth's formation to recover deposits of hydrocarbons and other desirable materials trapped in the formations. Typically, a well is drilled by connecting a drill bit to the lower end of a series of coupled sections of tubular pipe known as a drillstring. Drilling fluids, or mud, are pumped down through a central bore of the drillstring and exit through ports located at the drill bit. The drilling fluids act to lubricate and cool the drill bit, to carry cuttings back to the surface, and to establish sufficient hydrostatic "head" to prevent formation fluids from "blowing out" the wellbore once they are reached.

To sample and test fluids, such as deposits of hydrocarbons and other desirable materials trapped in the formations, a formation probe or tester is typically deployed in the well drilled through the formations. Various formation fluid testers for wireline and/or logging-while-drill applications are known in the art, such as those described in U.S. Pat. Nos. 4,860,581, 4,936,139, and 7,458,419. The entireties of these patents are hereby incorporated herein by reference.

Such formation fluid testers may include and utilize a focused probe apparatus, such as shown in FIG. 1. In FIG. 1, an apparatus 101 is shown that includes a first sealing element 111 and a second sealing element 121. The sealing elements 111 and 121 are two circular concentric sealing elements, in which the sealing element 111 is referred to as the "inner packer" and the sealing element 121 is referred to as the "outer packer." The area within the sealing element 111 is defined as a sample flow path 113, and the area between the sealing element 111 and sealing element 121 is defined as a guard flow path 123. The outer diameter of the sealing element 121 may be about 4.75 inches (12.1 cm).

During a sampling operation, the apparatus 101 may be pressed against the wall of a subterranean formation of interest. Fluid may then be drawn from the formation through the apparatus 101 via the sample flow path 113 and the guard flow path 123. Because of the flow dynamics encountered within the formation, fluid drawn into and flowing through the sample flow path 113 tends to have less contamination, such as less drilling fluid filtrate, as compared to fluid drawn into and flowing through the guard flow path 123. The apparatus 101 shown in FIG. 1 may be suitable when sampling in formations having medium to high mobility, but may be less effective in formations having low mobility.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 2:
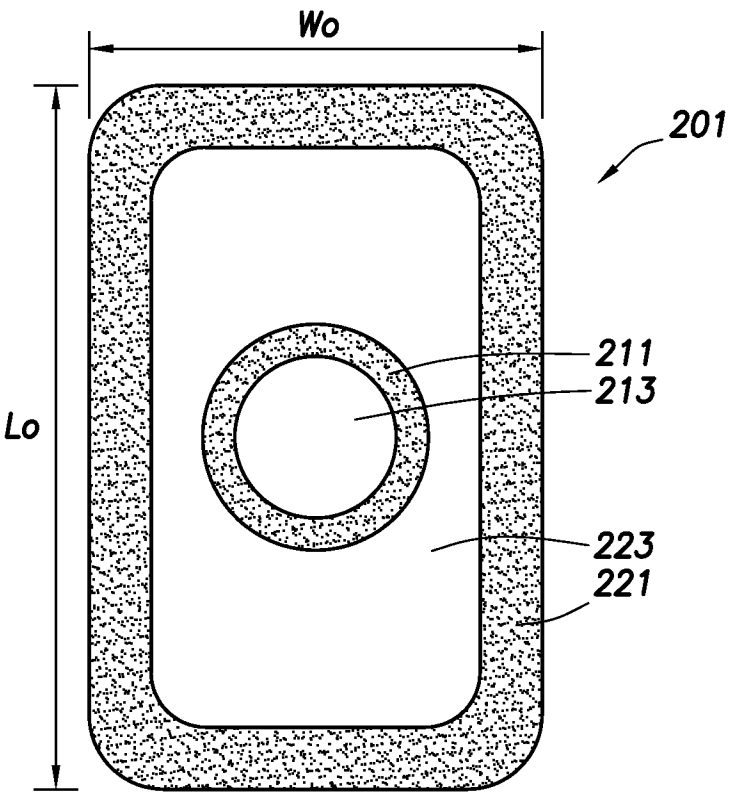
FIG. 2 is a schematic view of apparatus according to one or more aspects of the present disclosure.
Figure 1:
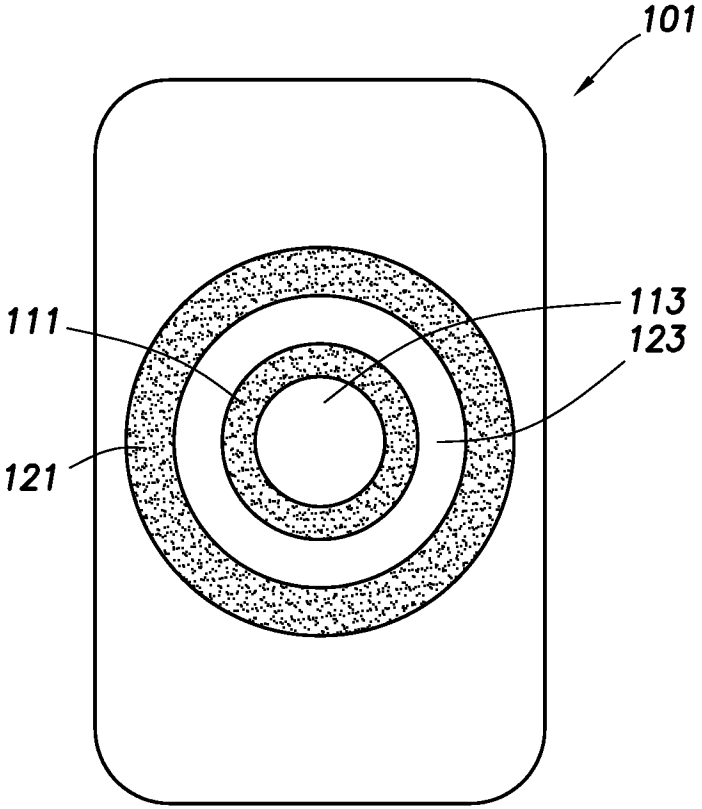
FIG. 1 is a schematic view of known apparatus.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

In accordance with one or more aspects of the present disclosure, an apparatus may be provided that may be used for sampling and/or testing operations. The apparatus may include a tool body and a probe assembly movably attached to the tool body. The tool body may be part of a downhole tool.

The downhole tool may be attached to a tool string, and may be used within a downhole environment. For example, the tool may be disposed into a wellbore formed within and extending into a subterranean formation. The probe assembly of the apparatus may include an inner sealing element and an outer sealing element. The inner sealing element may be disposed within the outer sealing element. The inner sealing element and/or the outer sealing element may have an "elongated shape." As used herein, an elongated shape for a sealing element may refer to a shape that may have different dimensions between the length of the sealing element and the width of the sealing element. For example, the sealing element may be elongated in shape by having a greater length for the sealing element than the width of the sealing element.

The apparatus may include a sample flow inlet configured to receive fluid from within the inner sealing element, and may include a guard flow inlet configured to receive fluid from between the inner sealing element and the outer sealing element. A flow line may then be coupled to the sample flow inlet to have the fluid from the sample flow inlet flow therethrough, and another flow line may be coupled to the guard flow inlet to have the fluid from the guard flow inlet flow therethrough.

The inner sealing element and the outer sealing element of the probe assembly may be movable with respect to each other. For example, the inner sealing element may be disposed on an inner plate, and the outer sealing element may be disposed on an outer plate, in which the inner plate and the outer plate may be movable with respect to each other.

Referring to FIG. 2, a schematic view is shown of an apparatus 201 in accordance with one or more aspects of the present disclosure. The apparatus 201 includes an inner sealing element 211 and an outer sealing element 221. The inner sealing element 211 is disposed within and/or encompassed by the outer sealing element 221. The inner sealing element 211 may define a sample flow path 213 within the area of the inner sealing element 211, in which fluid may be drawn within and through a sample flow inlet fluidly coupled to the sample flow path 213. The outer sealing element 221 may define a guard flow path 223 within the area between the outer sealing element 221 and the inner sealing element 211, in which fluid may be drawn within and through a guard flow inlet fluidly coupled to the guard flow path 223.

The inner sealing element 211 and/or the outer sealing element 221 may have an elongated shape. For example, as shown in FIG. 2, the outer sealing element 221 may have an elongated shape having a length $L_O$ and a width $W_O$, in which the length $L_O$ may be substantially greater than the width $W_O$. For example, the length $L_O$ of the outer sealing element 221 may be about 10 inches (25.4 cm), and the width $W_O$ of the outer sealing element 221 may be about 4.75 inches (12.1 cm). However, those having ordinary skill in the art will appreciate that dimensions for the sealing elements of the present disclosure are not so limited, and that other dimensions may be used within the scope of the present disclosure.

Figure 3:
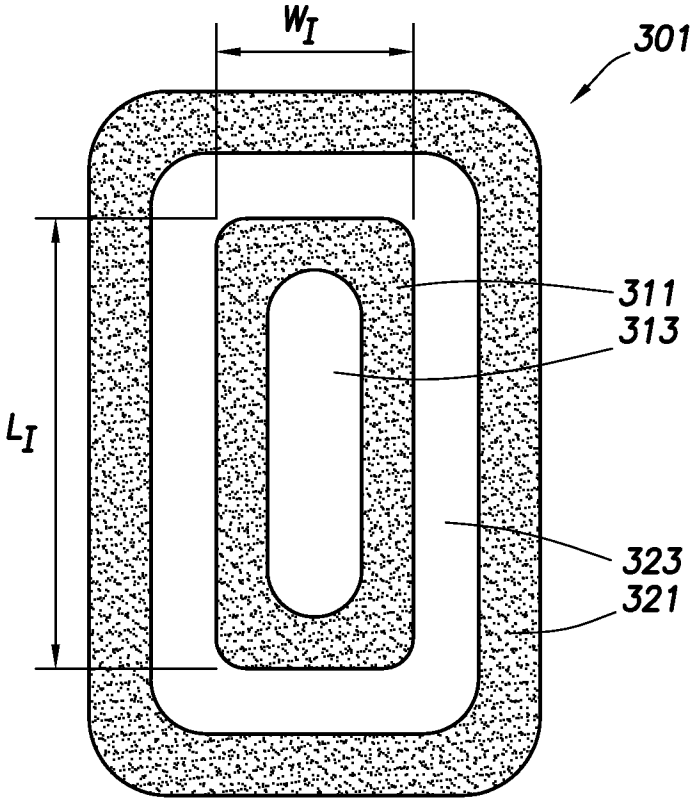
FIG. 3 is a schematic view of apparatus according to one or more aspects of the present disclosure.

Referring to FIG. 3, a schematic view is shown of an apparatus 301 in accordance with one or more aspects of the present disclosure. Similar to FIG. 2, the apparatus 301 includes an inner sealing element 311 and an outer sealing element 321, in which the inner sealing element 311 may define a sample flow path 313 and the outer sealing element 321 may define a guard flow path 323. In addition to the outer sealing element 321, the inner sealing element 311 may have an elongated shape. For example, the inner sealing element 311 may have a length $L_I$ and a width $W_I$, in which the length $L_I$ may be substantially greater than the width $W_I$. For example, the length $L_I$ of the inner sealing element 311 may be about 7 to 8 inches (17.8 cm to 20.3 cm), and the width $W_I$ of the inner sealing element 311 may be about 3 inches (7.6 cm).

Figure 4:
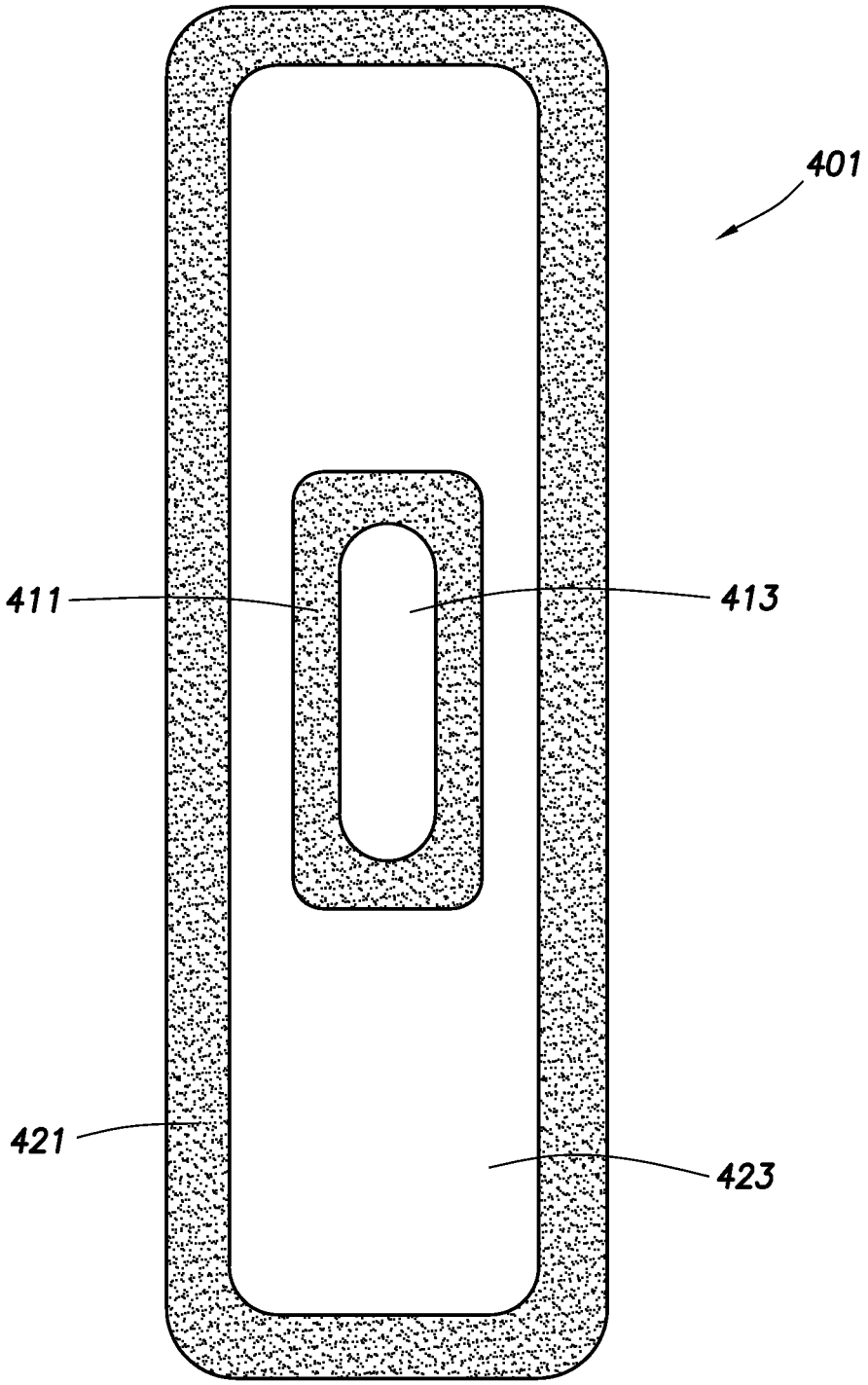
FIG. 4 is a schematic view of apparatus according to one or more aspects of the present disclosure.

Referring to FIG. 4, a schematic view is shown of an apparatus 401 in accordance with one or more aspects of the present disclosure. The apparatus 401 includes an inner sealing element 411 and an outer sealing element 421, in which the inner sealing element 411 may define a sample flow path 413 and the outer sealing element 421 may define a guard flow path 423. The inner sealing element 411 and the outer sealing element 421 may have an elongated shape. The outer sealing element 421 may have a length that is about twice the length of the outer sealing elements 221 and 321 shown in FIGS. 2 and 3. These dimensions may enable the guard flow path 423 to be substantially larger than the guard flow paths 223 and 323 shown in FIGS. 2 and 3, respectively. The inner sealing element 411 may have substantially the same shape as the inner sealing elements 211 and 311 shown in FIGS. 2 and 3. However, the inner sealing element 411 and/or the outer sealing element 421 may have other shapes, sizes, and/or dimensions such that the sealing elements have an elongated shape within the scope of the present disclosure.

Figure 5:
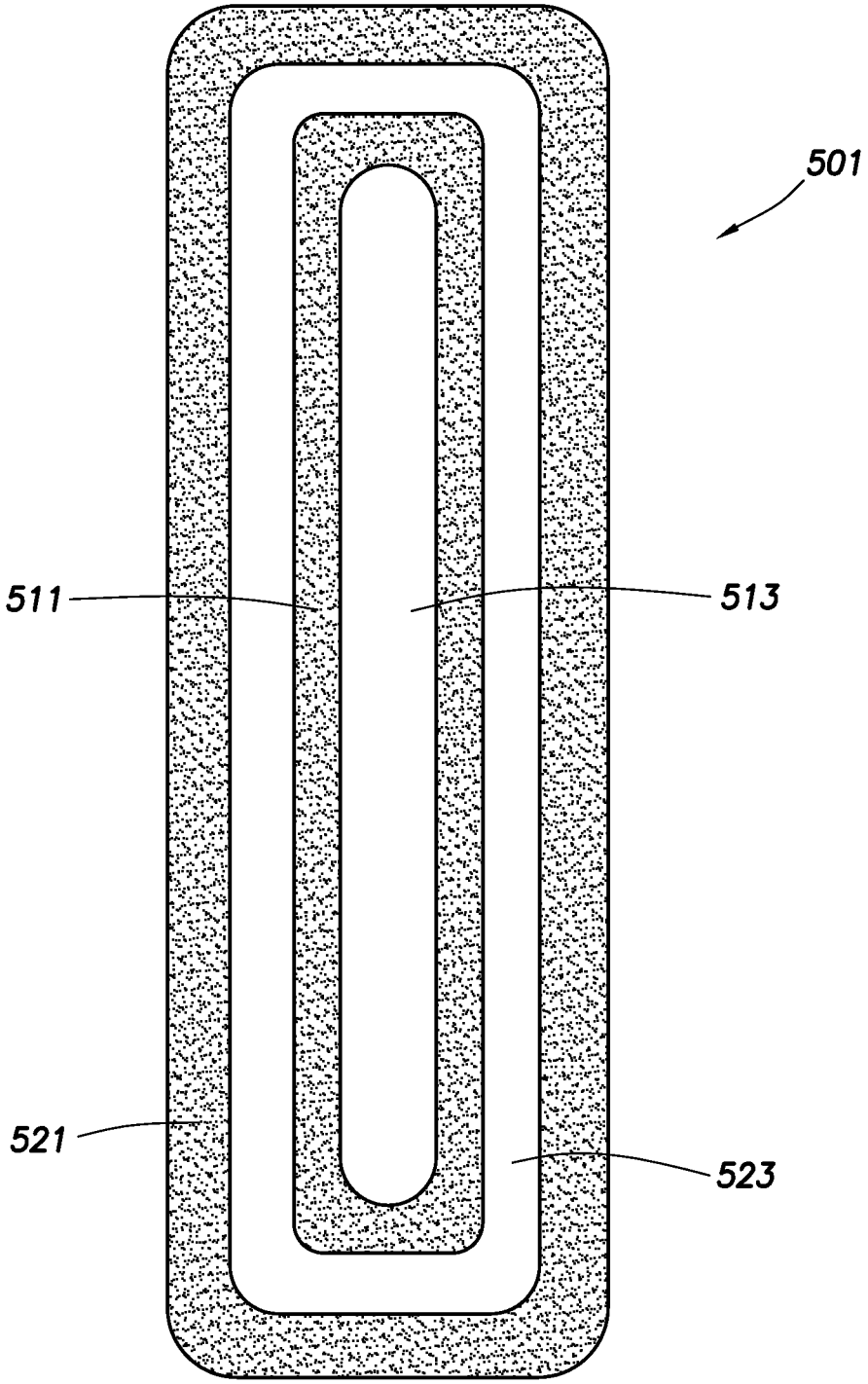
FIG. 5 is a schematic view of apparatus according to one or more aspects of the present disclosure.

Referring to FIG. 5, a schematic view is shown of an apparatus 501 in accordance with one or more aspects of the present disclosure. The apparatus 501 includes an inner sealing element 511 and an outer sealing element 521, in which the inner sealing element 511 may define a sample flow path 513 and the outer sealing element 521 may define a guard flow path 523. The inner sealing element 511 and the outer sealing element 521 each have an elongated shape. The outer sealing element 521 may be substantially similar to the outer sealing element 421 shown in FIG. 4, while the inner sealing element 511 may have a length that is about twice the length of the inner sealing elements 311 and 411 shown in FIGS. 3 and 4, respectively. These dimensions may enable the sample flow path 513 to be substantially larger than the sample flow paths shown in FIGS. 2, 3, and 4.

Figure 6:
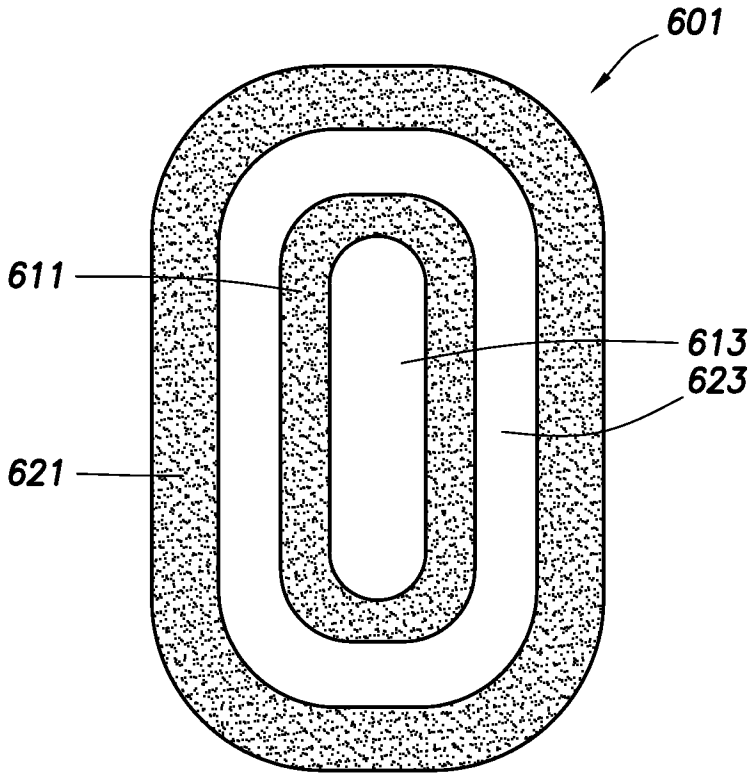
FIG. 6 is a schematic view of apparatus according to one or more aspects of the present disclosure.

Referring to FIG. 6, a schematic view is shown of an apparatus 601 in accordance with one or more aspects of the present disclosure. The apparatus 601 may include an inner sealing element 611 and an outer sealing element 621, in which the inner sealing element 611 may define a sample flow path 613 and the outer sealing element 621 may define a guard flow path 623. The inner sealing element 611 and the outer sealing element 621 have an elongated shape. One or more of the inner and/or outer corner radii of the inner sealing element 611 and/or the outer sealing element 621 may be substantially greater than the corner radii shown in FIG. 3. For example, one or more of the corner radii of the inner sealing element 611 and the outer sealing element 621 may be 0.25 inches or greater. Such larger corner radii may give the inner sealing element 611 and the outer sealing element 621 more of an oval shape, as compared to FIG. 3. One or more corner radii of the inner sealing element 611 and/or the outer sealing element 721 may be a full radius, or alternatively may have substantially little or no radius, such that the one or more corners of the inner sealing element and/or the outer sealing element may be substantially square.

Figure 7:
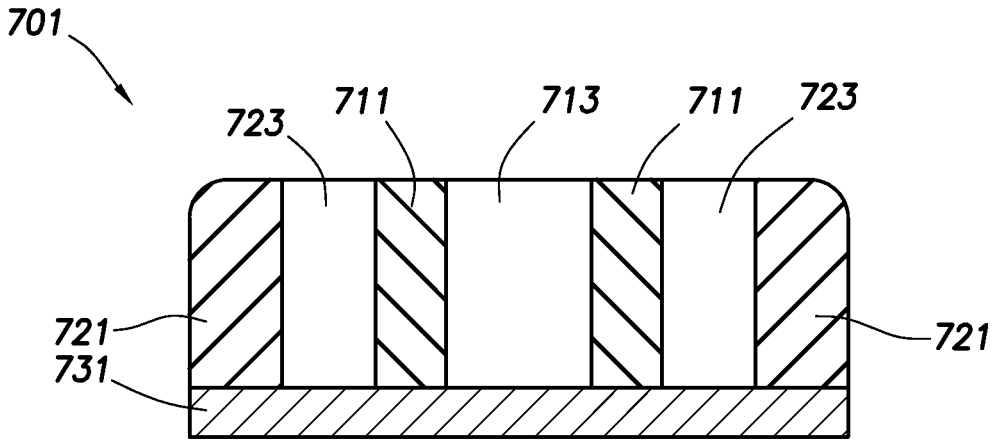
FIG. 7 is a schematic view of apparatus according to one or more aspects of the present disclosure.

Referring to FIG. 7, a schematic sectional view is shown of an apparatus 701 in accordance with one or more aspects of the present disclosure. The apparatus 701 may be identical or substantially similar to one or more of the apparatus shown in FIGS. 2-6. For example, the apparatus 701 includes an inner sealing element 711 and an outer sealing element 721, in which the inner sealing element 711 may define a sample flow path 713 and the outer sealing element 721 may define a guard flow path 723. The inner sealing element 711 and the outer sealing element 721 each have an elongated shape.

The inner sealing element 711 and/or the outer sealing element 721 may also be disposed upon a plate or other support 731. The support 731 may also include a bracket and/or other structure that the inner sealing element 711 and/or the outer sealing element 721 may be disposed on. The inner and outer sealing elements 711 and 721, respectively, may be coupled to the support 731 via mechanical fasteners, adhesive, and/or other means. For example, one or both of the sealing elements 711 and 721 may be molded (e.g., via injection molding) to the edges and/or apertures in the support 731.

The support 731 may be used to provide structure and/or support to the inner sealing element 711 and/or the outer sealing element 721. As such, the support 731 may be formed of and/or include a metal, such as steel, and/or any other rigid materials. Alternatively, the support 731 may be formed of and/or include a less rigid material and/or a non-rigid material, such as a compliant and/or bendable material. The support 731 may also be selectively and/or partially inflatable such that the support 731 may be able to move. The inner sealing element 711 and/or the outer sealing element 721 may be formed of and/or include a sealing material, such as an elastomeric material. The inner sealing element 711 and the outer sealing element 721 may also have substantially the same height, such as shown in FIG. 7. However, other shapes, sizes, and/or dimensions are also within the scope of the present disclosure.

Figure 8:
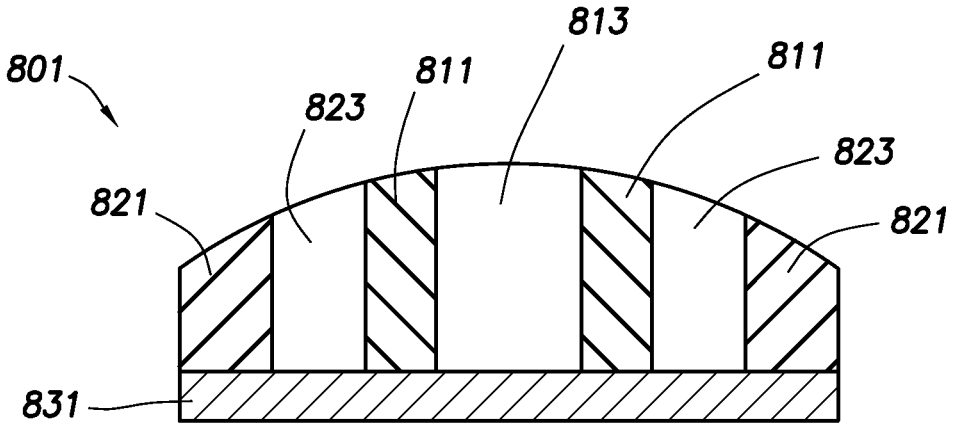
FIG. 8 is a schematic view of apparatus according to one or more aspects of the present disclosure.

Referring to FIG. 8, a schematic sectional view is shown of an apparatus 801 in accordance with one or more aspects of the present disclosure. The apparatus 801 may be identical or substantially similar to one or more of the apparatus shown in FIGS. 2-6. For example, the apparatus 801 includes an inner sealing element 811 and an outer sealing element 821, in which the inner sealing element 811 may define a sample flow path 813 and the outer sealing element 821 may define a guard flow path 823. The inner sealing element 811 and the outer sealing element 821 may have an elongated shape. The inner sealing element 811 and the outer sealing element 821 may also be disposed upon a support 831. The support 831 may be substantially similar or identical to the support 731 shown in FIG. 7.

As shown, one or more surfaces (e.g., sealing surfaces) of the inner sealing element 811 and/or the outer sealing element 821 may be rounded or cylindrical. For example, in FIG. 8, the upper surfaces (relative to the support 831) of the inner sealing element 811 and the outer sealing element 821 are rounded. This arrangement may facilitate engagement between the apparatus 801 and the wall of a wellbore within a subterranean formation. For example, as the wall of the wellbore may be rounded and/or have a radius or curvature, the inner sealing element 811 and the outer sealing element 821 may be rounded to at least partially correspond to the shape of the wellbore. The upper surfaces of the inner sealing element and the outer sealing element may correspond to substantially identical cylinders and/or have substantially similar radii of curvature, as shown in FIG. 8, and/or may have varying and/or different radii or curvature. The radii or curvature may be substantially equal to or less than the radius of the borehole in which use of the apparatus 801 is contemplated.

Figure 9A:
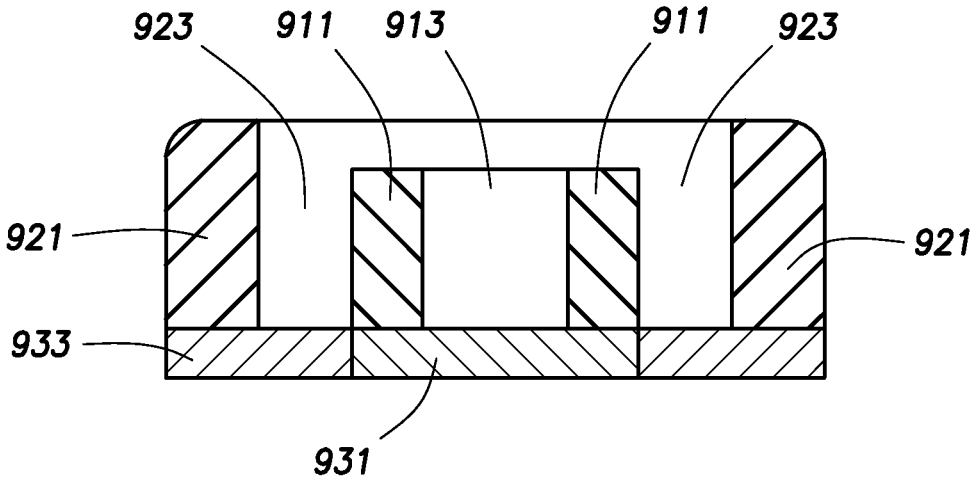
FIGS. 9A and 9B are schematic views of apparatus according to one or more aspects of the present disclosure.
Figure 9B:
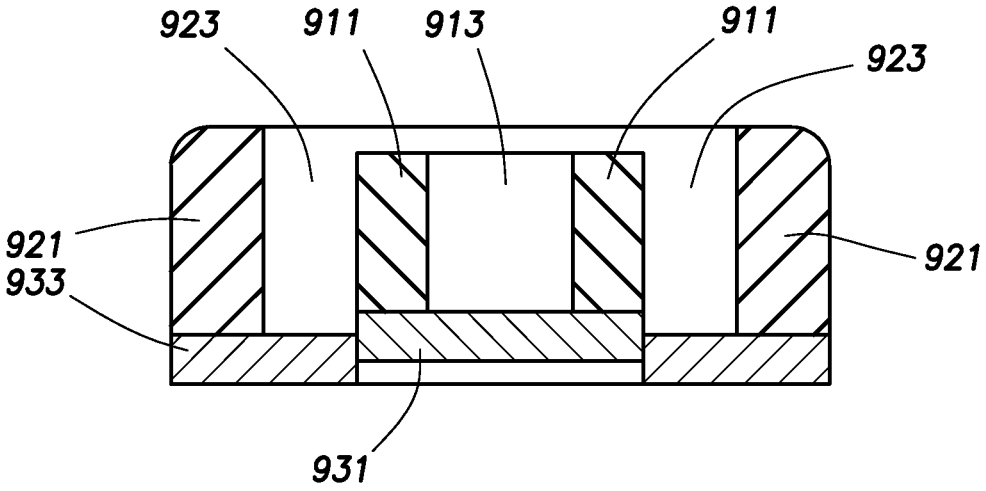

Referring to FIGS. 9A and 9B, schematic sectional views are shown of an apparatus 901 in accordance with one or more aspects of the present disclosure. The apparatus 701 may be identical or substantially similar to one or more of the apparatus shown in FIGS. 2-6. For example, the apparatus 901 includes an inner sealing element 911 and an outer sealing element 921, in which the inner sealing element 911 may define a sample flow path 913 and the outer sealing element 921 may define a guard flow path 923. The inner sealing element 911 and the outer sealing element 921 may have an elongated shape. As shown, the inner sealing element 911 may be disposed on an inner support 931, and the outer sealing element 921 may be disposed upon an outer support 933. The inner support 931 is disposed within and/or encompassed by the outer support 933. One or both of the inner and outer supports 931 and 933, respectively, may be substantially similar to the support 731 shown in FIG. 7, with the following exceptions.

The inner sealing element 911 may be movable with respect to the outer sealing element 921. An actuator may be coupled to the inner support 931 and configured to move the inner support 931 relative to the outer support 933 and/or the downhole tool to which the apparatus 901 is coupled. Additionally, or alternatively, an actuator may be coupled to the outer support 933 and configured to move the outer support 933 relative to the inner support 931 and/or the downhole tool to which the apparatus 901 is coupled. Such actuators may comprise hydraulic actuators, mechanical actuators, electrical actuators, and others.

The inner support 931 and the inner sealing element 911 disposed thereon may be able to move independently of the outer support 933 and the outer sealing element 921 disposed thereon. This arrangement may improve the ability of the inner sealing element 911 and/or the outer sealing element 921 to sealingly engage the subterranean formation. For example, the inner sealing element 911 may have a force applied thereto through the inner support 931, and the outer sealing element 921 may have a force applied thereto through the outer support 933, in which these forces may be the same or different in magnitude, and which may be applied simultaneously, serially, or otherwise.

The inner sealing element 911 and the outer sealing element 921 may have substantially different heights, such as shown in FIGS. 9A and 9B. For example, the inner sealing element 911 may have a substantially smaller height than the outer sealing element 921. However, the inner sealing element 911 may alternatively have a substantially larger height than the outer sealing element 921, or have the same height as the outer sealing element 921.

Figure 10A:
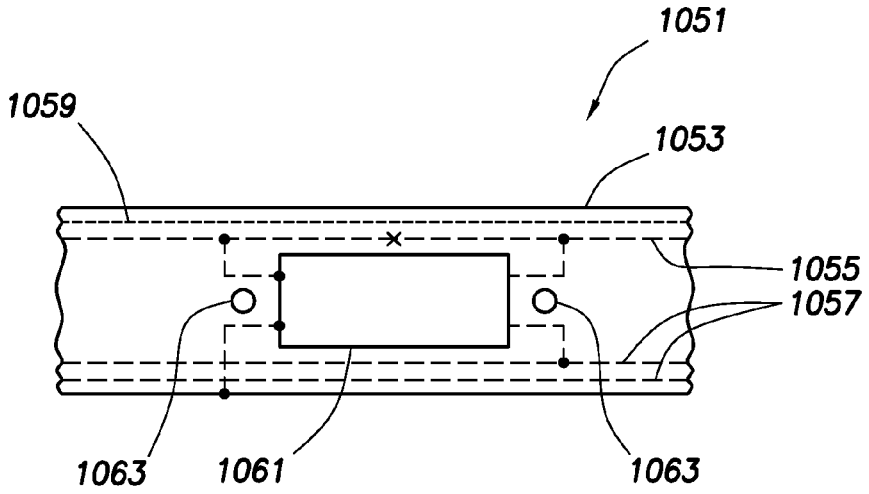
FIGS. 10A and 10B are schematic views of apparatus according to one or more aspects of the present disclosure.
Figure 10B:
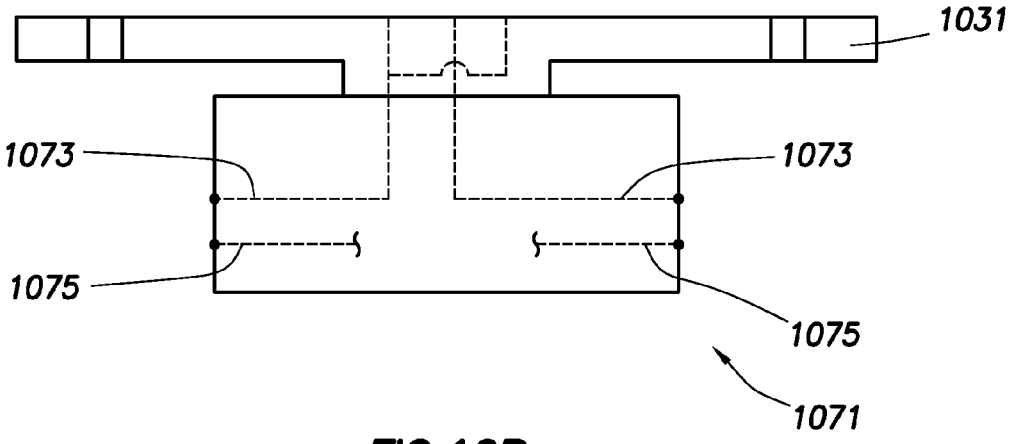

Referring to FIGS. 10A and 10B, multiple views are shown of an apparatus in accordance with one or more aspects of the present disclosure. Particularly, FIG. 10A shows a top schematic view of a downhole tool 1051 having an aperture 1061 formed therethrough, and FIG. 10B shows a side schematic view of a probe assembly 1071.

In FIG. 10A, the downhole tool 1051 includes a tool body 1053 configured for use within a downhole environment. The tool body 1053 may be substantially cylindrical in shape. The aperture 1061 may be formed within the downhole tool 1051 such that the aperture 1061 may extend substantially through the tool body 1051.

The downhole tool 1051 may have one or more flow lines extending therethrough. For example, as shown in FIG. 10A, the tool body 1053 may have one or more flow lines 1055 formed therethrough. The one or more flow lines 1055 may be configured to transport fluid, such as fluid that has been retrieved using the probe assembly 1071, into and through the downhole tool 1051. For example, fluid retrieved using the downhole tool 1051 may be transported to one or more sampling bottles and/or the wellbore using the flow lines 1055. The tool body 1053 may also include one or more hydraulic lines 1057 formed therethrough. The one or more hydraulic lines 1057 may be used to actuate one or more components of the downhole tool 1051, such as to actuate one or more actuators 1063 (e.g., pistons), that may be fluidly coupled to the hydraulic lines 1057. The tool body 1053 may also include one or more electrical lines 1059 formed therethrough. The one or more electrical lines 1059 may also be used within the downhole tool 1051 to convey electrical power and/or signals.

In FIG. 10B, the probe assembly 1071 is shown. The probe assembly 1071 may be movably disposed within the aperture 1061 of the downhole tool 1051. The probe assembly 1071 may include a support 1031, such as a plate, on which sealing elements (not shown) may be disposed. The probe assembly 1071 may be movably attached to the tool body 1053, such as by attaching the actuators 1063 to the support 1031 of the probe assembly 1071. As such, the probe assembly 1071, and the sealing elements included therewith, may be able to move with respect to the tool body 1053. Accordingly, during movement, the probe assembly 1071 may be selectively disposed within and extended from the aperture 1061 of the tool body 1053.

The sealing elements disposed on the support 1031 may be substantially similar or identical to one or more of the sealing elements shown in FIGS. 2-6, among other such sealing elements within the scope of the present disclosure. The support 1031 may be substantially similar or identical to the support 731 shown in FIG. 7, among other such supports within the scope of the present disclosure.

The probe assembly 1071 may have one or more flow lines 1073 formed therethrough, such as to transport fluid retrieved by the probe assembly 1071, and may also have one or more hydraulic lines 1075 formed therethrough, such as to actuate one or more components of the probe assembly 1071. The flow lines 1073 of the probe assembly 1071 may then fluidly couple to the flow lines 1055 of the tool body 1053, and the hydraulic lines 1075 of the probe assembly 1071 may fluidly couple to the hydraulic lines 1057 of the tool body 1053. As such, one or more of the apparatus shown in FIGS. 2-9B may be included within the tool body and probe assembly shown in FIGS. 10A and 10B.

Figure 11A:
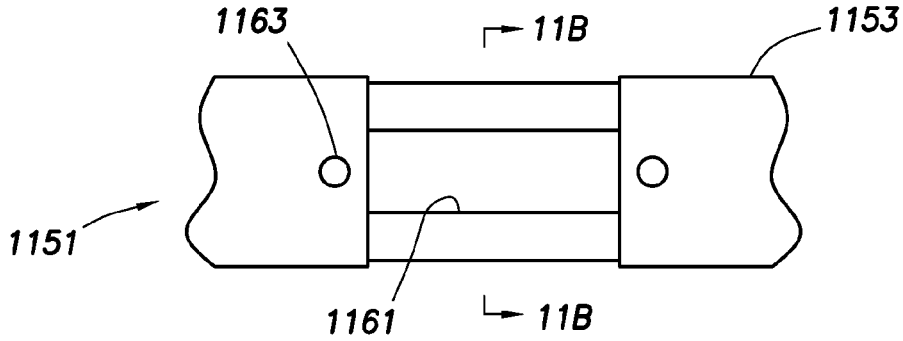
FIGS. 11A, 11B, and 11C are multiple views of apparatus according to one or more aspects of the present disclosure.
Figure 11B:
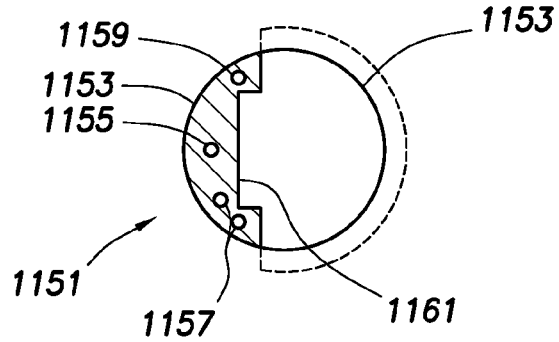
Figure 11C:
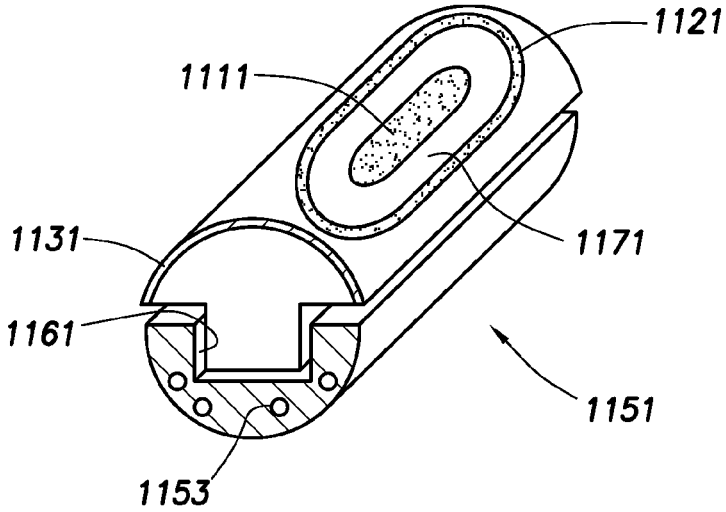

Referring to FIGS. 11A, 11B, and 11C, multiple views are shown of an apparatus in accordance with one or more aspects of the present disclosure. Particularly, FIG. 11A shows a top view of a downhole tool 1151 having an aperture 1161 formed therein, FIG. 11B shows a sectional view of the downhole tool 1151, and FIG. 11C shows a perspective view of the downhole tool 1151 with a probe assembly 1171.

The downhole tool 1151 includes a tool body 1153, in which the tool body 1153 may be used within a downhole environment, such as disposed within a wellbore extending into a subterranean formation. As such, the tool body 1153 may be substantially cylindrical in shape. The aperture 1161 may be formed within the downhole tool 1151 such that the aperture 1161 extends into the tool body 1151. Rather than having the aperture extend through the tool body, the aperture 1161 may extend only partially into the tool body 1151.

The downhole tool 1151 may have one or more lines extending therethrough. For example, as shown in FIG. 11B, the tool body 1153 may have one or more flow lines 1155 formed therethrough, may have one or more hydraulic lines 1157 formed therethrough, and/or may have one or more electrical lines 1159 formed therethrough. The one or more hydraulic lines 1157 may be used within the downhole tool 1151 to actuate one or more components of the downhole tool 1151, such as to actuate one or more actuators 1163 (e.g., pistons), that may be fluidly coupled to the hydraulic lines 1157.

In FIG. 11C, the probe assembly 1171 is shown. The probe assembly 1171 may be disposed, such as movably disposed, within the aperture 1161 of the downhole tool 1151. The probe assembly 1171 may include a support 1131, in which an elongated sample flow path 1111 and an elongated guard flow path 1121 are provided. The support 1131, sample flow path 1111 and guard flow path 1121 may be substantially similar, or have one or more similar aspects, relative to those shown in the preceding figures and/or described above. For example, the sample flow path 1111 and the guard flow pat 1121 may be at least partially defined by sealing elements that may be disposed upon the support 1131. The support 1131 may be cylindrical in shape, at least partially, to help conform to the shape of the wellbore wall. The probe assembly 1171 may be movably attached to the tool body 1153, such as by attaching the actuators 1163 to the support 1131 of the probe assembly 1171. As such, the probe assembly 1171, and the sample flow path 1111 and the guard flow path 1121 included therewith, may be able to move with respect to the tool body 1153. Accordingly, during movement, the probe assembly 1171 may be selectively disposed within and extended from the aperture 1161 of the tool body 1153.

Though only two actuators 1163 are shown in FIG. 11A, a single actuator or more than two actuators may alternatively be used within the scope of the present disclosure. One or more of the actuators 1163 may be fixed when attached to the support 1131 of the probe assembly 1131. Alternatively, one or more of the actuators 1163 may be rotatably attached to the support 1131, such as rotatably attached (e.g., ball joint) at the attachment point between the actuators 1163 and the support 1131. This arrangement may improve the ability of the probe assembly 1171, including the sealing elements, to engage, such as sealingly engage, with the subterranean formation and/or the wellbore wall.

Figure 12:
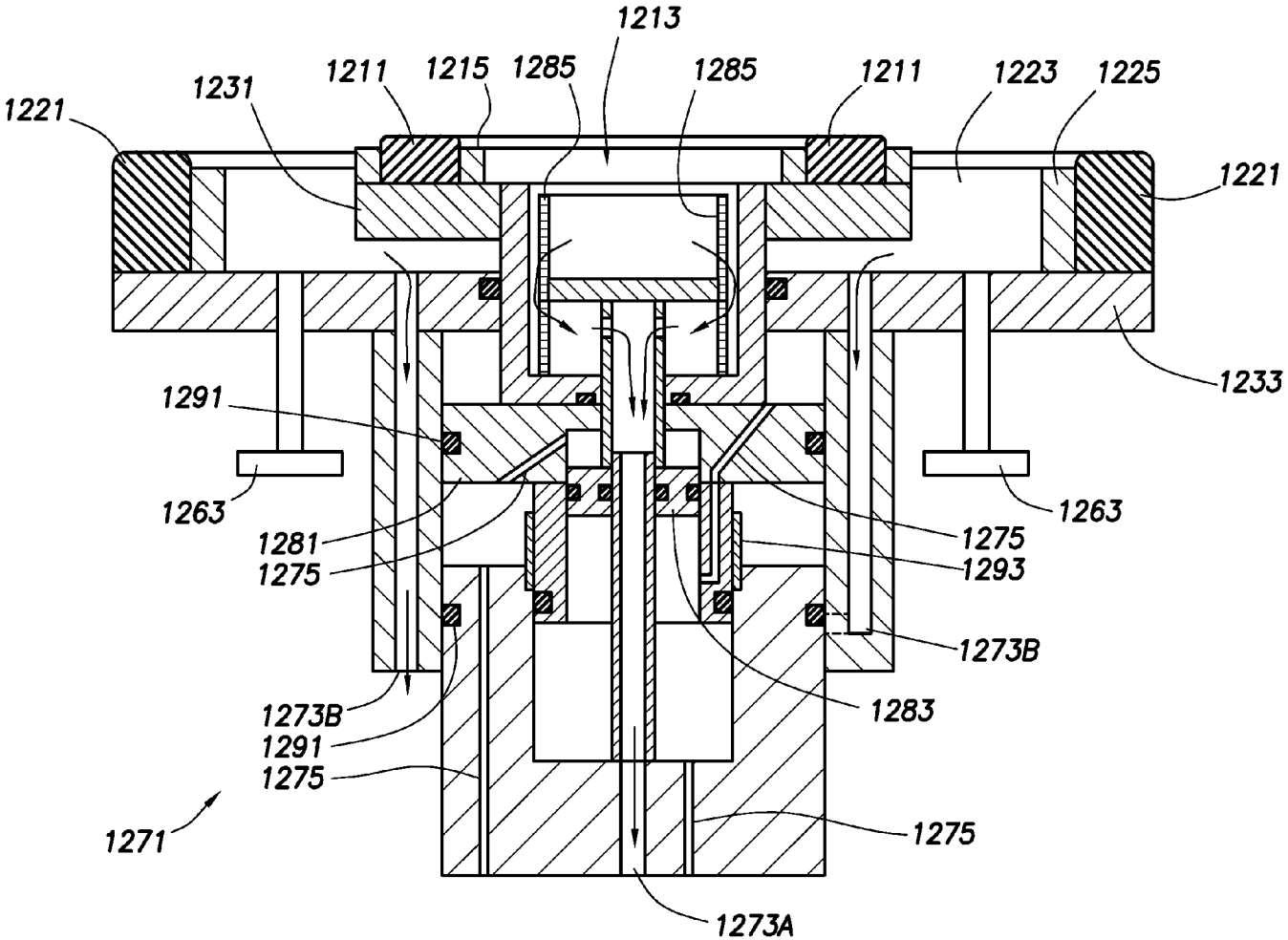
FIG. 12 is a schematic view of apparatus according to one or more aspects of the present disclosure.

Referring to FIG. 12, a sectional view is shown of a probe assembly 1271 in accordance with one or more aspects of the present disclosure. The probe assembly 1271 may be substantially similar, or have one or more similar aspects, relative to one or more of the probe apparatus shown in the preceding figures and/or discussed above. For example, the probe assembly 1271 may include an elongated inner sealing element 1211 and an elongated outer sealing element 1221, in which the inner sealing element 1211 may at least partially define a sample flow path 1213 and the outer sealing element 1221 may at least partially define a guard flow path 1223. The inner sealing element 1211 and the outer sealing element 1221 may also have an elongated shape. The inner sealing element 1211 may be disposed on an inner support 1231, and the outer sealing element 1221 may be disposed upon an outer support 1233. The inner support 1231 and/or the outer support 1233 may be plates, such as plates having an elongated shape, and/or as otherwise described above with respect to the preceding figures.

The probe assembly 1271 may have one or more actuators coupled thereto. For example, as shown in FIG. 12, one or more actuators 1263, such as pistons, may be coupled and attached to the probe assembly 1271. The actuators 1263 may be used to movably attach the probe assembly 1271 to a tool body, such as by attaching the actuators 1263 to the outer support 1233.

The probe assembly 1271 may have one or more lines extending therethrough. The probe assembly 1271 may have one or more hydraulic lines 1275 formed therethrough, such as to actuate one or more components of the probe assembly. For example, the hydraulic lines 1275 may be fluidly coupled to one or more actuators within the probe assembly 1271. As shown, in one aspect, the probe assembly 1271 may include an actuator 1281, such as a piston, that is attached to the inner support 1231, in which the actuator 1281 may be fluidly coupled to and actuated by the hydraulic lines 1275.

As fluid flows through the hydraulic lines 1275 into the cavities within the probe assembly 1271 adjacent to the actuator 1281, the actuator 1281 may respond to the fluid pressure from the hydraulic lines 1275 by moving, thereby moving the inner support 1231 attached to the actuator 1281. The inner sealing element 1211 disposed on the inner support 1231 may also move with the inner support 1231, thereby enabling the inner sealing element 1211 to move with respect to the outer sealing element 1221. This arrangement may improve the ability of the inner sealing element 1211 and/or the outer sealing element 1221 to engage, such as sealingly engage, with the subterranean formation. For example, the inner sealing element 1211 may have a force applied thereto through the inner support 1231, and the outer sealing element 1221 may have a force applied thereto through the outer support 1233, in which these forces may be the same or different, as desired.

As shown, the probe assembly 1271 may include an actuator 1283, such as a piston, that is disposed adjacent to and fluidly couples to an inlet of the sample flow path 1213. As such, as fluid flows through the hydraulic lines 1275 into the cavities within the probe assembly 1271 adjacent to the actuator 1283, the actuator 1283 may respond to the fluid pressure from the hydraulic lines 1275 by moving, thereby opening and closing the inlet of the sample flow path 1213. The probe assembly 1271 may include a filter 1285, such as by having the filter 1285 disposed adjacent to the inlet of the sample flow path 1213. Accordingly, as fluid enters through the sample flow path 1213, fluid may pass through the filter 1285, such as to remove particulates and/or solid matter from the fluid entering through the sample flow path 1213.

The probe assembly 1271 may have one or more flow lines 1273 formed therethrough, such as to transport fluid retrieved by the probe assembly 1271. For example, as shown, the probe assembly 1271 may include one or more flow lines 1273A fluidly coupled to the inlet of the sample flow path 1213. As such, as fluid enters into and through the sample flow path 1213, the fluid may be transported away through the flow line 1273A fluidly coupled to the sample flow path 1213. Similarly, the probe assembly 1271 may include one or more flow lines 1273B fluidly coupled to one or more inlets of the guard flow path 1223. As such, as fluid enters into and through the guard flow path 1223, the fluid may be transported away through the flow line 1273B fluidly coupled to the guard flow path 1223.

As discussed above, fluid drawn into and flowing through the sample flow path 1213 may have less contamination as compared to fluid drawn into and flowing through the guard flow path 1223. Fluid from the sample flow path 1213 may be directed to flow to one or more sample chambers, sample bottles, and/or uphole for testing. Fluid from the guard flow path 1223 may be directed to flow back to the wellbore, as this fluid may be less desirable for sampling and/or testing. Those having ordinary skill in the art, however, will appreciate that the present disclosure is not so limited, as both or neither of the flow paths and flow lines fluidly coupled thereto may be used for sampling and/or testing.

One or more sealing element supports may be included with the sealing elements. For example, as shown in FIG. 12, an inner sealing element support 1215 may be disposed adjacent to the inner sealing element 1213, and/or an outer sealing element support 1225 may be disposed adjacent to the outer sealing element 1223. The sealing element supports 1215 and 1225 may be used to support the sealing elements 1213 and 1223, respectively. As such, the sealing element supports 1215 and 1225 may be formed of and/or include a rigid and/or non-rigid material. For example, the sealing element supports 1215 and 1225 may prevent extrusion and/or deformation of the sealing elements 1213 and 1223, such as during testing and/or sampling with the probe assembly 1271, thereby improving the reliability and sealing ability of the probe assembly 1271.

One or more sealing elements may be disposed within the probe assembly 1271, such as to prevent leakage within the probe assembly 1271. For example, as shown in FIG. 12, one or more sealing elements 1291, such as o-rings, may be disposed adjacent to one or more moving components of the probe assembly 1271, such as adjacent to the actuators 1281 and 1283. As such, the sealing elements 1291 may be used to prevent leakage within and adjacent to the actuators 1281 and 1283.

One or more keys may be disposed within and/or included within the probe assembly. For example, as shown in FIG. 12, one or more keys 1293 may be included within the probe assembly 1271, such as disposed adjacent to and/or disposed on one or more of the moving components of the probe assembly 1271. As such, the keys 1293 may be used to prevent rotation of one moving component with respect to another adjacent component.

One or more valves may be disposed within and/or fluidly coupled to the probe assembly 1271. For example, a valve, such as a sequence valve, may be fluidly coupled to one or more of the flow lines and/or hydraulic lines of the probe assembly. By having a sequence valve fluidly coupled to the probe assembly, the sequence valve may be able to control the sequence of movements and/or actions taken by the probe assembly. For example, a sequence valve may be used to move the actuator 1281 before the actuator 1283, or vice-versa. Accordingly, one or more valves may be included with and/or fluidly coupled to the probe assembly.

Figure 13:
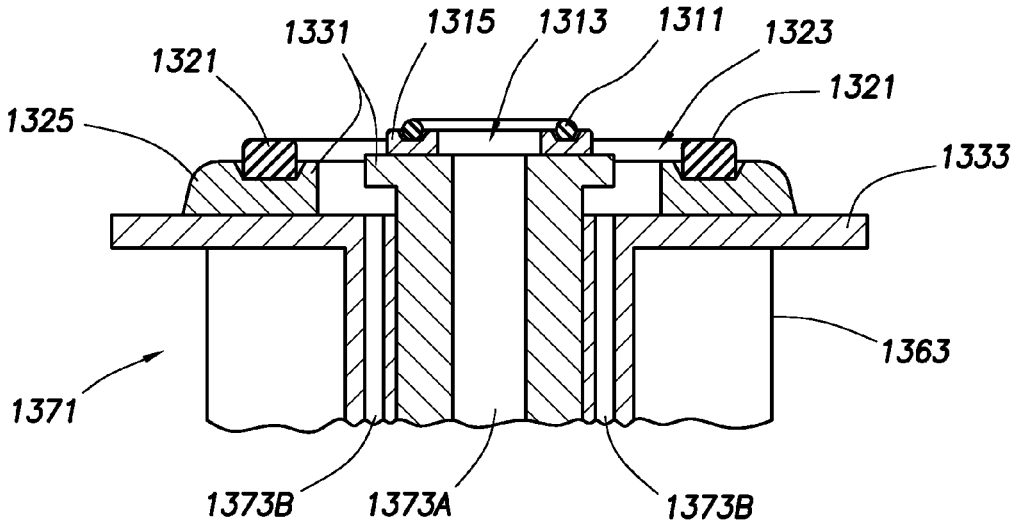
FIG. 13 is a schematic view of apparatus according to one or more aspects of the present disclosure.

Referring to FIG. 13, a sectional view is shown of a probe assembly 1371 in accordance with one or more aspects of the present disclosure. The probe assembly 1371 may be substantially similar to, or have one or more similar aspects, relative to the apparatus shown in the preceding figures and/or described above. For example, the probe assembly 1371 may include an inner sealing element 1311 and an outer sealing element 1321, in which the inner sealing element 1311 may at least partially define a sample flow path 1313 and the outer sealing element 1321 may at least partially define a guard flow path 1323. The sample flow path 1313 and/or the guard flow path 1323 may have an elongated shape. The inner sealing element 1311 and the outer sealing element 1321 may also have an elongated shape. The inner sealing element 1311 may be disposed on an inner support 1331, and the outer sealing element 1321 may be disposed upon an outer support 1333. The inner and outer supports 1331, 1333, may be substantially similar to those shown in FIGS. 9A and 9B. For example, the inner support 1331 and/or the outer support 1333 may be plates, such as plates having an elongated shape.

One or more actuators 1363, such as pistons, may be coupled and attached to the probe assembly 1371. Particularly, the actuators 1363 may be used to movably attach the probe assembly 1371 to a tool body, such as by attaching the actuators 1363 to the outer support 1333. An inner sealing element support 1315 may be disposed adjacent to the inner sealing element 1313, and/or an outer sealing element support 1325 may be disposed adjacent to the outer sealing element 1323. The sealing element supports 1315 and 1325 may also enable to have a gap and/or space adjacent to the sealing elements 1313 and 1323 to enable movement and/or deformation of the sealing elements 1313 and 1323. The probe assembly 1371 may include one or more flow lines 1373A fluidly coupled to the inlet of the sample flow path 1313, and may also include one or more flow lines 1373B fluidly coupled to one or more inlets of the guard flow path 1323.

One or more sealing elements of the present disclosure may be formed from and/or include a sealing material, such as a compliant material, that may include silicon rubber, a fluoroelastomeric (FKM) rubber (such as provided by FKM Viton®) or copolymer rubber (such as FEPM, provided by AFLAS®). One or more sealing element supports of the present disclosure may be formed from and/or include hydrogenated nitrile butadiene rubber (hnbr), poly-ether-ether-ketone (PEEK), as well as composites having, for example, metallic reinforcements.

Figure 14:
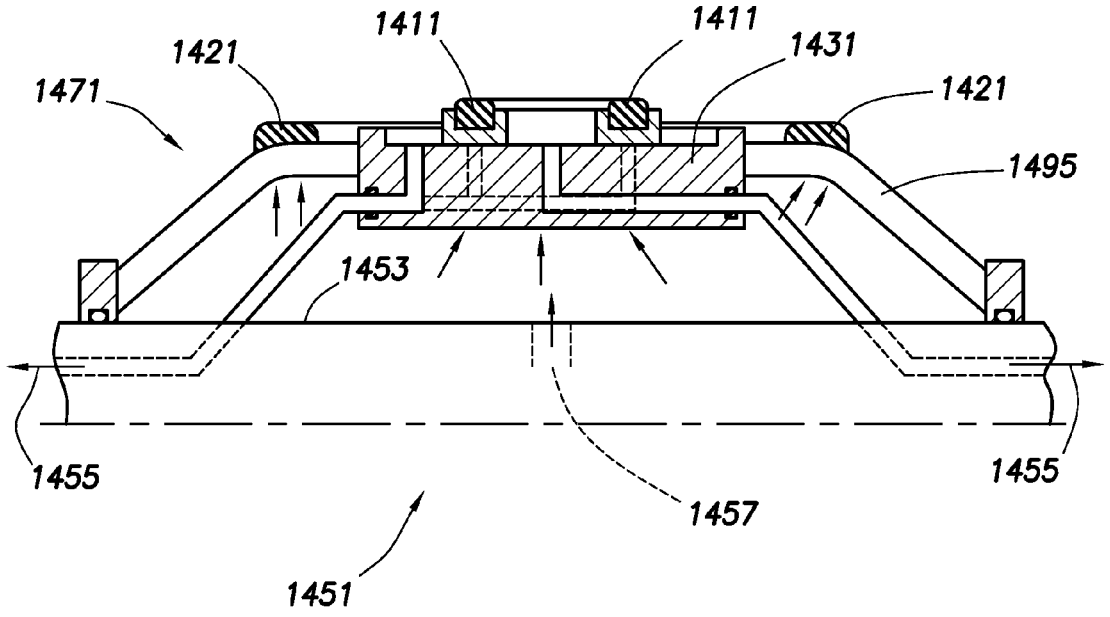
FIG. 14 is a schematic view of apparatus according to one or more aspects of the present disclosure.

Referring to FIG. 14, a sectional view is shown of an apparatus in accordance with one or more aspects of the present disclosure. A downhole tool 1451 may be provided with a probe assembly 1471 movably attached thereto, in which the probe assembly 1471 may be movably attached with a packer 1495, such as an inflatable packer. The downhole tool 1451 includes a tool body 1453, in which the tool body 1453 may be used within a downhole environment, such as disposed within a borehole extending into a subterranean formation.

The downhole tool 1451 may have one or more lines extending therethrough. For example, as shown in FIG. 14, the tool body 1453 may have one or more flow lines 1455 formed therethrough, and/or may have one or more hydraulic lines 1457 formed therethrough. The one or more hydraulic lines 1457 may be used within the downhole tool 1451 to actuate one or more components of the downhole tool 1451, such as actuate and/or inflate the packer 1495, which may be fluidly coupled to the hydraulic lines 1457.

The probe assembly 1471 may include a support 1431, in which an inner sealing element 1411 and/or an outer sealing element 1421 may be disposed upon the support 1431. For example, in FIG. 14, the support 1431 may only have the inner sealing element 1411 disposed upon the support 1431, in which the outer sealing element 1421 may be disposed on the packer 1495. As such, the probe assembly 1471, and the inner sealing element 1411 and the outer sealing element 1421 included therewith, may be able to move with respect to the tool body 1453, such as when inflating the packer 1495. This arrangement may improve the ability of the probe assembly 1471, including the inner sealing element 1411 and/or the outer sealing element 1421, to engage, such as sealingly engage, with the subterranean formation.

Figure 15:
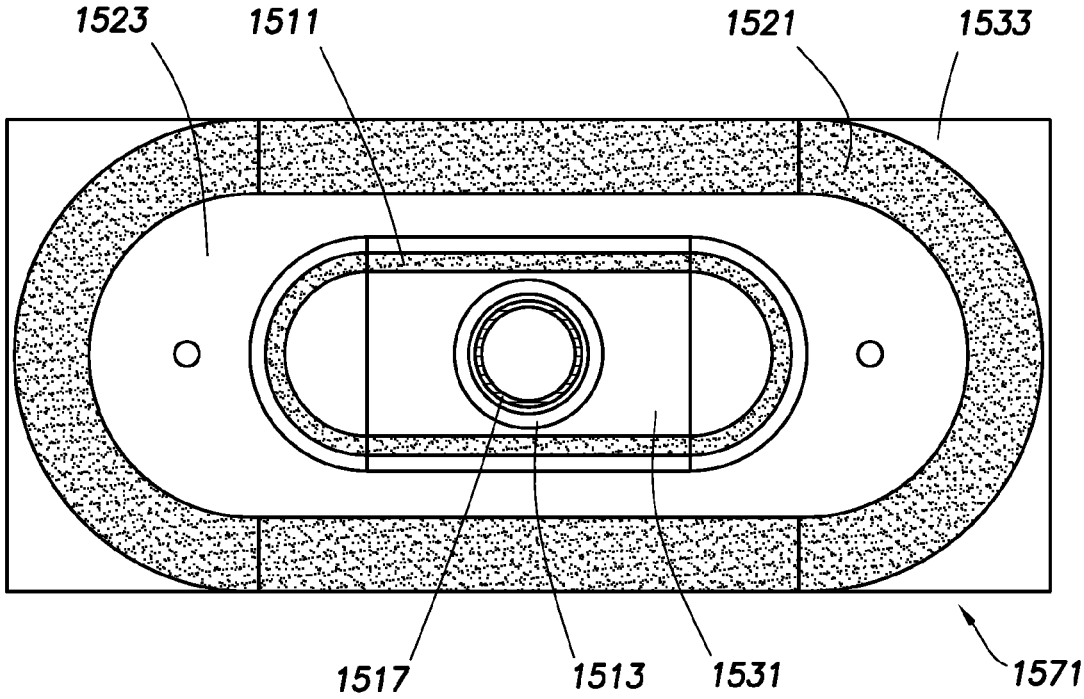
FIG. 15 is a schematic view of apparatus according to one or more aspects of the present disclosure.

Referring to FIG. 15, a top view is shown of a probe assembly 1571 in accordance with one or more aspects of the present disclosure. The probe assembly 1571 may be substantially similar to, or have one or more similar aspects, relative to the apparatus shown in the preceding figures and/or described above. For example, the probe assembly 1571 may include an inner sealing element 1511 and an outer sealing element 1521, in which the inner sealing element 1511 may define a sample flow path 1513 and the outer sealing element 1521 may define a guard flow path 1523. The inner sealing element 1511 and the outer sealing element 1521 may have an elongated shape. The sample flow path 1513 and/or the guard flow path 1523 may also have an elongated shape. The inner sealing element 1511 may also be disposed on an inner support 1531, and the outer sealing element 1521 may be disposed upon an outer support 1533. For example, the inner support 1531 may be disposed at least partially above the outer support 1533. Alternatively, the inner support 1531 may be disposed within and/or encompassed by the outer support 1533. The inner support 1531 and/or the outer support 1533 may have an elongated shape. The inner support 1531 may slide with respect to or extend from the outer support 1533.

The probe assembly 1571 may include one or more inlets for the sample flow path and/or the guard flow path. For example, and as shown in FIG. 15, the sample flow path 1513 may have an inlet 1517, in which a flow line may be fluidly coupled to the inlet 1517. The inlet 1517 may then be selectively opened and closed, such as with one or more actuators. As shown in FIG. 15, the inlet 1517 may have a substantially circular shape. However, other shapes may be used for an inlet in accordance with the present disclosure.

Figure 16:
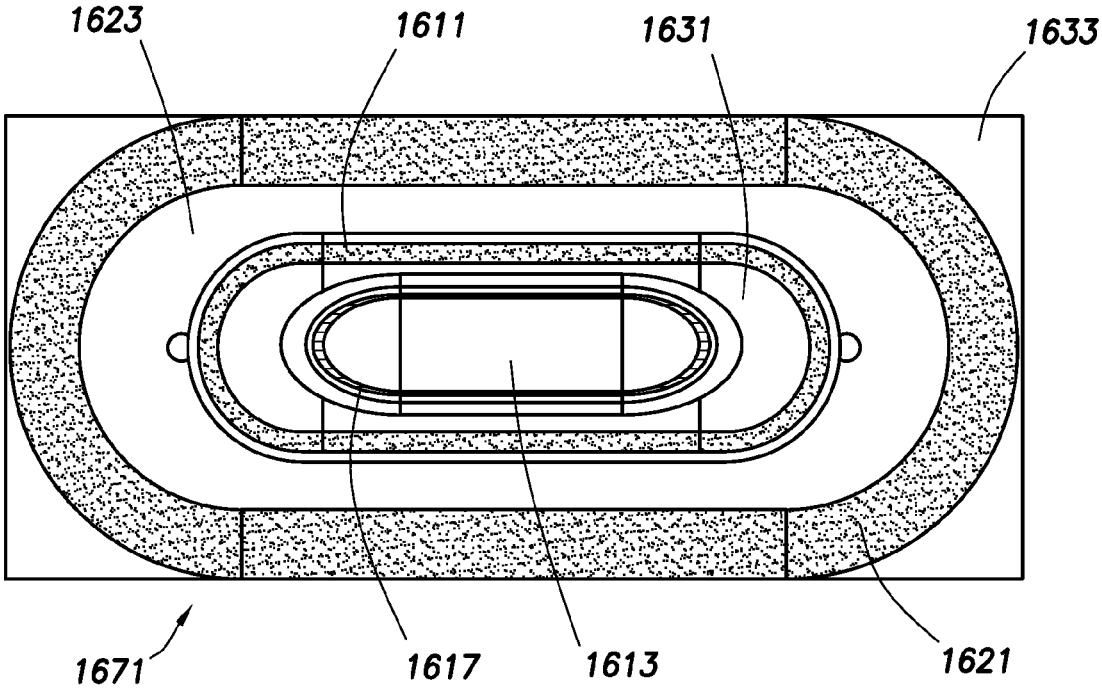
FIG. 16 is a schematic view of apparatus according to one or more aspects of the present disclosure.

Referring to FIG. 16, a top view is shown of a probe assembly 1671 in accordance with one or more aspects of the present disclosure. The probe assembly 1671 is substantially similar or identical to the probe assembly 1571 shown in FIG. 15, with the following possible exceptions. The probe assembly 1671 may include an inner sealing element 1611 and an outer sealing element 1621, in which the inner sealing element 1611 may define a sample flow path 1613 and the outer sealing element 1621 may define a guard flow path 1623. The inner sealing element 1611 and the outer sealing element 1621 may have an elongated shape. The sample flow path 1613 and/or the guard flow path 1623 may also have an elongated shape. The inner sealing element 1611 may be disposed on an inner support 1631, and the outer sealing element 1621 may be disposed upon an outer support 1633. The sample flow path 1613 may have an inlet 1617, in which a flow line may be fluidly coupled to the inlet 1617. Compared to the inlet 1517 in FIG. 15, the inlet 1617 may have a substantially oval shape. This may enable the sample flow path 1613 to have a larger filtering or flow area, as compared to the sample flow path 1513 in FIG. 15.

In accordance with one or more aspects of the present disclosure, an outer sealing element may have a length of about 10 in (25.4 cm) and a width of about 5 in (12.7 cm), and an inner sealing element may have a length of about 8.1 in (20.6 cm) and a width of about 2.8 in (7.1 cm). As such, a guard flow path may have a length of about 8.8 in (22.4 cm) and a width of about 3.6 in (9.2 cm), and a sample flow path may have a length of about 6.8 in (17.3 cm) and a width of about 1.6 in (4.0 cm). This may enable a probe assembly to have an area of about 19.8 $in^2$ (127.7 $cm^2$) for the sample flow path and the guard flow path, an area of about 10.7 $in^2$ (69.0 $cm^2$) for the sample flow path, and a production rate (e.g., flow rate) ratio of about 1 to 2.1 between the sample flow path and the guard flow path. These dimensions may be applicable to the apparatus shown in one or more of FIGS. 2-16. While other dimensions are also within the scope of the present disclosure, the inventors have shown experimentally that such a production rate ratio provides unexpected and substantial improvements over the prior art.

Figure 17:
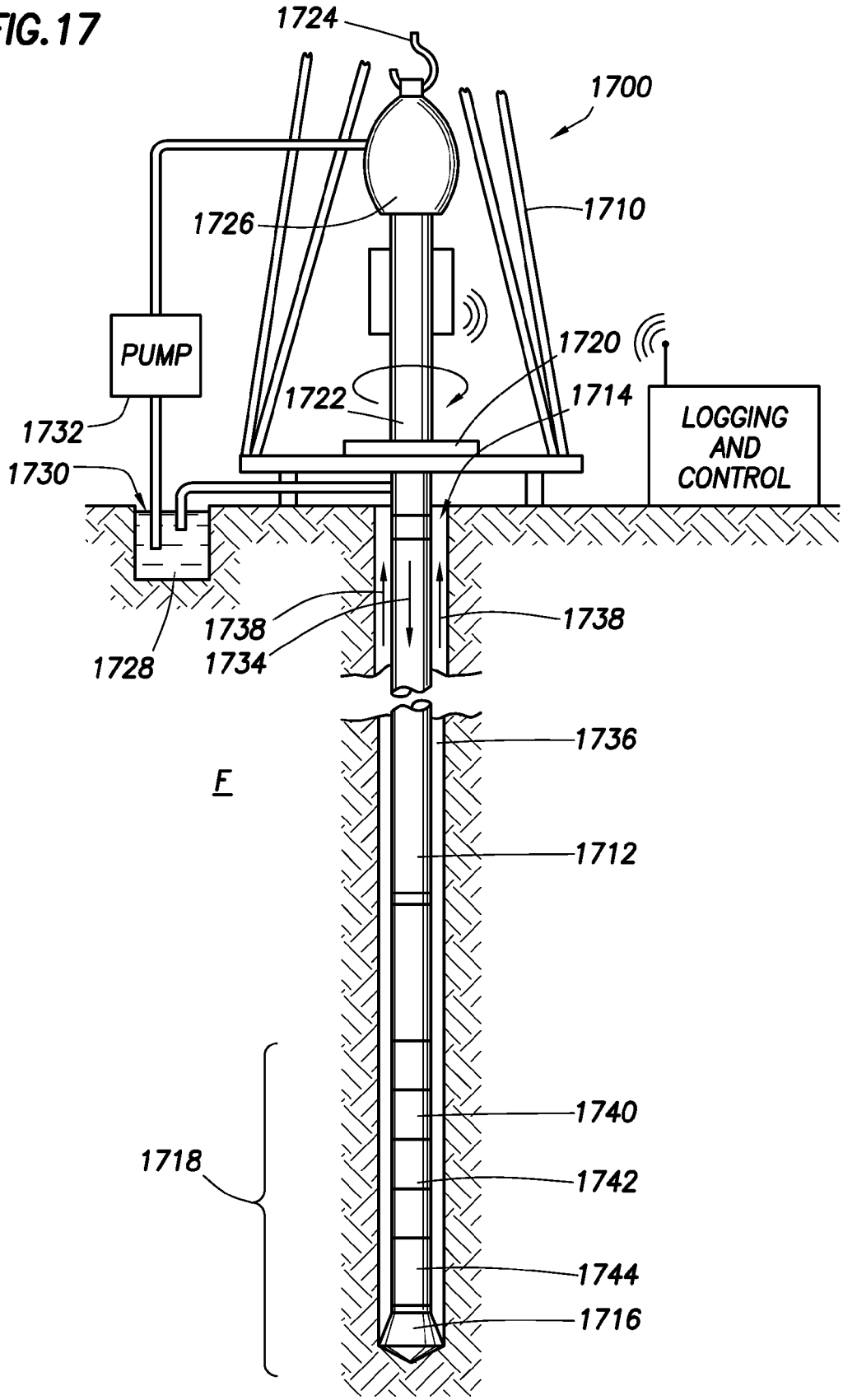
FIG. 17 is a schematic view of apparatus according to one or more aspects of the present disclosure.

Referring to FIG. 17, illustrated is a schematic view of a wellsite 1700 having a drilling rig 1710 with a drill string 1712 suspended therefrom in accordance with one or more aspects of the present disclosure. The wellsite 1700 shown, or one similar thereto, may be used within onshore and/or offshore locations. In this embodiment, a wellbore 1714 may be formed within a subterranean formation F, such as by using rotary drilling, or any other method known in the art. As such, one or more embodiments in accordance with the present disclosure may be used within a wellsite, similar to the one as shown in FIG. 17 (discussed more below). Those having ordinary skill in the art will appreciate that the present disclosure may be used within other wellsites or drilling operations, such as within a directional drilling application, without departing from the scope of the present disclosure.

The drill string 1712 may suspend from the drilling rig 1710 into the wellbore 1714. The drill string 1712 may include a bottom hole assembly 1718 and a drill bit 1716, in which the drill bit 1716 may be disposed at an end of the drill string 1712. The surface of the wellsite 1700 may have the drilling rig 1710 positioned over the wellbore 1714, and the drilling rig 1710 may include a rotary table 1720, a kelly 1722, a traveling block or hook 1724, and may additionally include a rotary swivel 1726. The rotary swivel 1726 may be suspended from the drilling rig 1710 through the hook 1724, and the kelly 1722 may be connected to the rotary swivel 1726 such that the kelly 1722 may rotate with respect to the rotary swivel.

An upper end of the drill string 1712 may be connected to the kelly 1722, such as by threadingly connecting the drill string 1712 to the kelly 1722, and the rotary table 1720 may rotate the kelly 1722, thereby rotating the drill string 1712 connected thereto. As such, the drill string 1712 may be able to rotate with respect to the hook 1724. Those having ordinary skill in the art, however, will appreciate that though a rotary drilling system is shown in FIG. 17, other drilling systems may be used without departing from the scope of the present disclosure. For example, a top-drive (also known as a "power swivel") system may be used without departing from the scope of the present disclosure. In such a top-drive system, the hook 1724, swivel 1726, and kelly 1722 are replaced by a drive motor (electric or hydraulic) that may apply rotary torque and axial load directly to drill string 1712.

The wellsite 1700 may include drilling fluid 1728 (also known as drilling "mud") stored in a pit 1730. The pit 1730 may be formed adjacent to the wellsite 1700, as shown, in which a pump 1732 may be used to pump the drilling fluid 1728 into the wellbore 1714. The pump 1732 may pump and deliver the drilling fluid 1728 into and through a port of the rotary swivel 1726, thereby enabling the drilling fluid 1728 to flow into and downwardly through the drill string 1712, the flow of the drilling fluid 1728 indicated generally by direction arrow 1734. This drilling fluid 1728 may then exit the drill string 1712 through one or more ports disposed within and/or fluidly connected to the drill string 1712. For example, the drilling fluid 1728 may exit the drill string 1712 through one or more ports formed within the drill bit 1716.

As such, the drilling fluid 1728 may flow back upwardly through the wellbore 1714, such as through an annulus 1736 formed between the exterior of the drill string 1712 and the interior of the wellbore 1714, the flow of the drilling fluid 1728 indicated generally by direction arrow 1738. With the drilling fluid 1728 following the flow pattern of direction arrows 1734 and 1738, the drilling fluid 1728 may be able to lubricate the drill string 1712 and the drill bit 1716, and/or may be able to carry formation cuttings formed by the drill bit 1716 (or formed by any other drilling components disposed within the wellbore 1714) back to the surface of the wellsite 1700. As such, this drilling fluid 1728 may be filtered and cleaned and/or returned back to the pit 1730 for recirculation within the wellbore 1714.

Though not shown, the drill string 1712 may include one or more stabilizing collars. A stabilizing collar may be disposed within and/or connected to the drill string 1712, in which the stabilizing collar may be used to engage and apply a force against the wall of the wellbore 1714. This may enable the stabilizing collar to prevent the drill string 1712 from deviating from the desired direction for the wellbore 1714. For example, during drilling, the drill string 1712 may "wobble" within the wellbore 1714, thereby enabling the drill string 1712 to deviate from the desired direction of the wellbore 1714. This wobble may also be detrimental to the drill string 1712, components disposed therein, and the drill bit 1716 connected thereto. However, a stabilizing collar may be used to minimize, if not overcome altogether, the wobble action of the drill string 1712, thereby possibly increasing the efficiency of the drilling performed at the wellsite 1700 and/or increasing the overall life of the components at the wellsite 1700.

As discussed above, the drill string 1712 may include a bottom hole assembly 1718, such as by having the bottom hole assembly 1718 disposed adjacent to the drill bit 1716 within the drill string 1712. The bottom hole assembly 1718 may include one or more components included therein, such as components to measure, process, and/or store information. The bottom hole assembly 1718 may include components to communicate and/or relay information to the surface of the wellsite.

As such, as shown in FIG. 17, the bottom hole assembly 1718 may include one or more logging-while-drilling ("LWD") tools 1740 and/or one or more measuring-while-drilling ("MWD") tools 1742. The bottom hole assembly 1718 may also include a steering-while-drilling system (e.g., a rotary-steerable system) and motor 1744, in which the rotary-steerable system and motor 1744 may be coupled to the drill bit 1716.

The LWD tool 1740 shown in FIG. 17 may include a thick-walled housing, commonly referred to as a drill collar, and may include one or more of a number of logging tools known in the art. Thus, the LWD tool 1740 may be capable of measuring, processing, and/or storing information therein, as well as capabilities for communicating with equipment disposed at the surface of the wellsite 1700.

The MWD tool 1742 may also include a housing (e.g., drill collar), and may include one or more of a number of measuring tools known in the art, such as tools used to measure characteristics of the drill string 1712 and/or the drill bit 1716. The MWD tool 1742 may also include an apparatus for generating and distributing power within the bottom hole assembly 1718. For example, a mud turbine generator powered by flowing drilling fluid therethrough may be disposed within the MWD tool 1742. Alternatively, other power generating sources and/or power storing sources (e.g., a battery) may be disposed within the MWD tool 1742 to provide power within the bottom hole assembly 1718. As such, the MWD tool 1742 may include one or more of the following measuring tools: a weight-on-bit measuring device, a torque measuring device, a vibration measuring device, a shock measuring device, a stick slip measuring device, a direction measuring device, an inclination measuring device, and/or any other device known in the art used within an MWD tool.

According to one or more aspects of the present disclosure, the LWD tool 1740 may comprise a carrier module having a sample chamber for conveying an injection fluid into the wellbore 1714. A piston may be disposed in the sample chamber, the piston defining a first chamber and a second chamber within the sample chamber. The sample chamber may comprise a first fluid port fluidly coupled to the first chamber, and a second fluid port fluidly coupled to the second chamber. The carrier module may comprise a flow regulator fluidly coupled to at least one of the first fluid port and the second fluid port. The LWD tool 1740 may be used to inject fluid from the sample chamber into the formation F as described herein.

Figure 18:
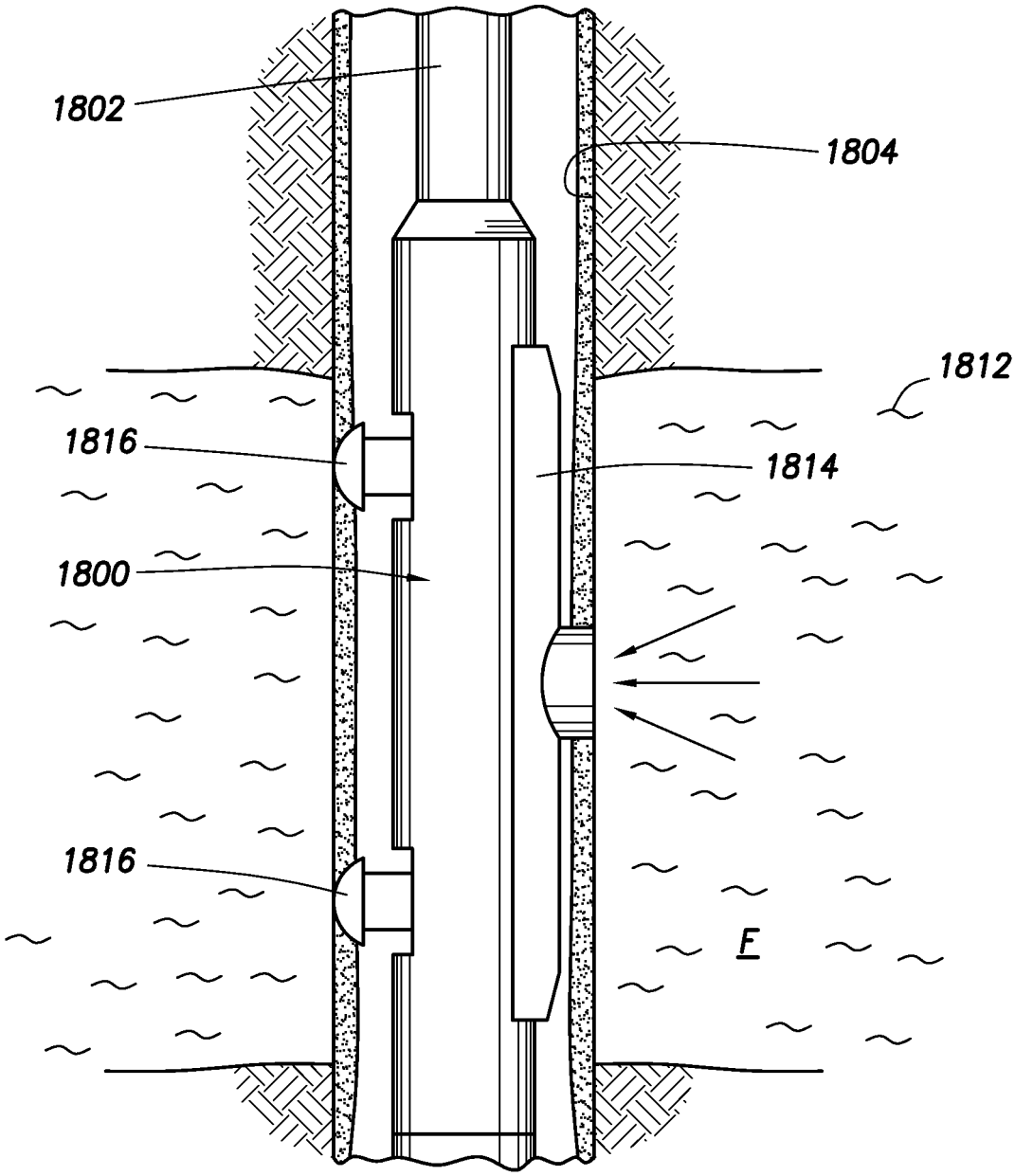
FIG. 18 is a schematic view of apparatus according to one or more aspects of the present disclosure.

Referring to FIG. 18, illustrated is a schematic view of a tool 1800 in accordance with one or more aspects of the present disclosure. The tool 1800 may be connected to and/or included within a drill string 1802, in which the tool 1800 may be disposed within a wellbore 1804 formed within a subterranean formation F. As such, the tool 1800 may be included and used within a bottom hole assembly, as described above.

Particularly, the tool 1800 may include a sampling-while drilling ("SWD") tool, such as that described within U.S. Pat. No. 7,114,562, filed on Nov. 24, 2003, entitled "Apparatus and Method for Acquiring Information While Drilling," and incorporated herein by reference in its entirety. As such, the tool 1800 may include a probe 1810 to hydraulically establish communication with the subterranean formation F and draw formation fluid 1812 into the tool 1800.

The tool 1800 may also include a stabilizer blade 1814 and/or one or more pistons 1816. As such, the probe 1810 may be disposed on the stabilizer blade 1814 and extend therefrom to engage the wall of the wellbore 1804. The pistons, if present, may also extend from the tool 1800 to assist probe 1810 in engaging with the wall of the wellbore 1804. Alternatively, though, the probe 1810 may not necessarily engage the wall of the wellbore 1804 when drawing fluid.

As such, fluid 1812 drawn into the tool 1800 may be measured to determine one or more parameters of the subterranean formation F, such as pressure and/or pretest parameters of the subterranean formation F. Additionally, the tool 1800 may include one or more devices, such as sample chambers or sample bottles, that may be used to collect formation fluid samples. These formation fluid samples may be retrieved back at the surface with the tool 1800. Alternatively, rather than collecting formation fluid samples, the formation fluid 1812 received within the tool 1800 may be circulated back out into the subterranean formation F and/or wellbore 1804. As such, a pumping system may be included within the tool 1800 to pump the formation fluid 1812 circulating within the tool 1800. For example, the pumping system may be used to pump formation fluid 1812 from the probe 1810 to the sample bottles and/or back into the formation F.

According to one or more aspects of the present disclosure, the tool 1800 may be used to inject fluid through the probe 1810 and into the formation F as described herein. As such, the tool 1800 may comprise a carrier module having a sample chamber for conveying an injection fluid into the wellbore 1804. A piston may be disposed in the sample chamber, the piston defining a first chamber and a second chamber within the sample chamber. The sample chamber may comprise a first fluid port fluidly coupled to the first chamber, and a second fluid port fluidly coupled to the second chamber. The carrier module may comprise a flow regulator fluidly coupled to at least one of the first fluid port and the second fluid port.

Figure 19:
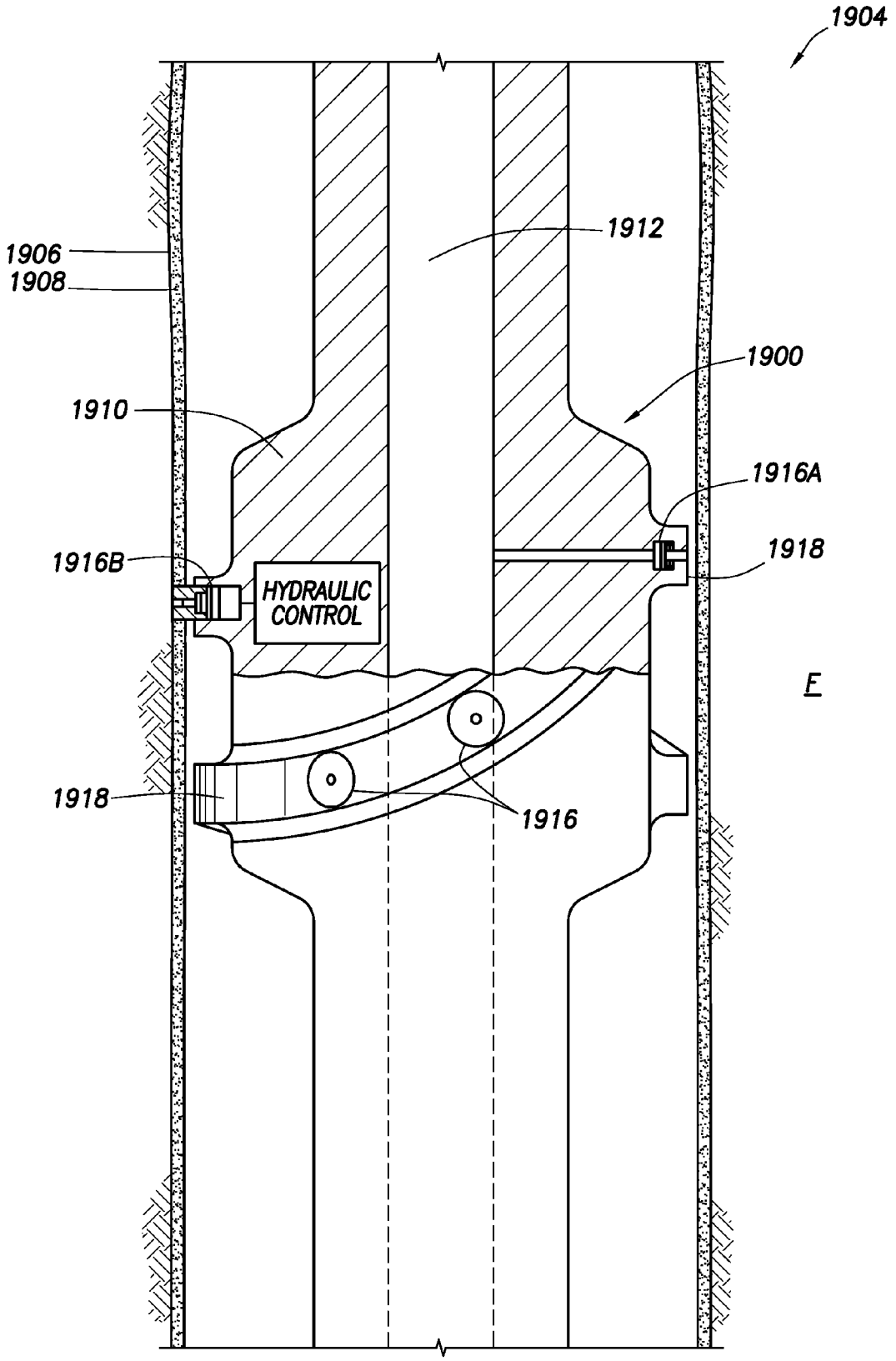
FIG. 19 is a schematic view of apparatus according to one or more aspects of the present disclosure.

Referring to FIG. 19, illustrated is a schematic view of a tool 1900 in accordance with one or more aspects of the present disclosure. The tool 1900 may be connected to and/or included within a bottom hole assembly, in which the tool 1900 may be disposed within a wellbore 1904 formed within a subterranean formation F.

The tool 1900 may be a pressure LWD tool used to measure one or more downhole pressures, including annular pressure, formation pressure, and pore pressure, before, during, and/or after a drilling operation. Those having ordinary skill in the art will appreciate that other pressure LWD tools may also be utilized in one or more aspects, such as that described within U.S. Pat. No. 6,986,282, filed on Feb. 18, 2003, entitled "Method and Apparatus for Determining Downhole Pressures During a Drilling Operation," and incorporated herein by reference.

As shown, the tool 1900 may be formed as a modified stabilizer collar 1910, similar to a stabilizer collar as described above, and may have a passage 1912 formed therethrough for drilling fluid. The flow of the drilling fluid through the tool 1900 may create an internal pressure $P_1$, and the exterior of the tool 1900 may be exposed to an annular pressure $P_A$ of the surrounding wellbore 1904 and formation F. A differential pressure $P_\delta$ formed between the internal pressure $P_1$ and the annular pressure $P_A$ may then be used to activate one or more pressure devices 1916 that may be included within the tool 1900.

The tool 1900 may include two pressure measuring devices 1916A and 1916B that may be disposed on stabilizer blades 1918 formed on the stabilizer collar 1910. The pressure measuring device 1916A may be used to measure the annular pressure $P_A$ in the wellbore 1904, and/or may be used to measure the pressure of the formation F when positioned in engagement with a wall 1906 of the wellbore 1904. As shown in FIG. 19, the pressure measuring device 1916A is not in engagement with the wellbore wall 1906, thereby enabling the pressure measuring device 1916A to measure the annular pressure $P_A$, if desired. However, when the pressure measuring device 1916A is moved into engagement with the wellbore wall 1906, the pressure measuring device 1916A may be used to measure pore pressure of the formation F.

As also shown in FIG. 19, the pressure measuring device 1916B may be extendable from the stabilizer blade 1918, such as by using a hydraulic control disposed within the tool 1900. When extended from the stabilizer blade 1918, the pressure measuring device 1916B may establish sealing engagement with the wall 1906 of the wellbore 1904 and/or a mudcake 1908 of the wellbore 1904. This may also enable the pressure measuring device 1916B to take measurements of the formation F. Other controllers and circuitry, not shown, may be used to couple the pressure measuring devices 1916 and/or other components of the tool 1900 to a processor and/or a controller. The processor and/or controller may then be used to communicate the measurements from the tool 1900 to other tools within a bottom hole assembly or to the surface of a wellsite. As such, a pumping system may be included within the tool 1900, such as including the pumping system within one or more of the pressure devices 1916 for activation and/or movement of the pressure devices 1916.

Figure 20:
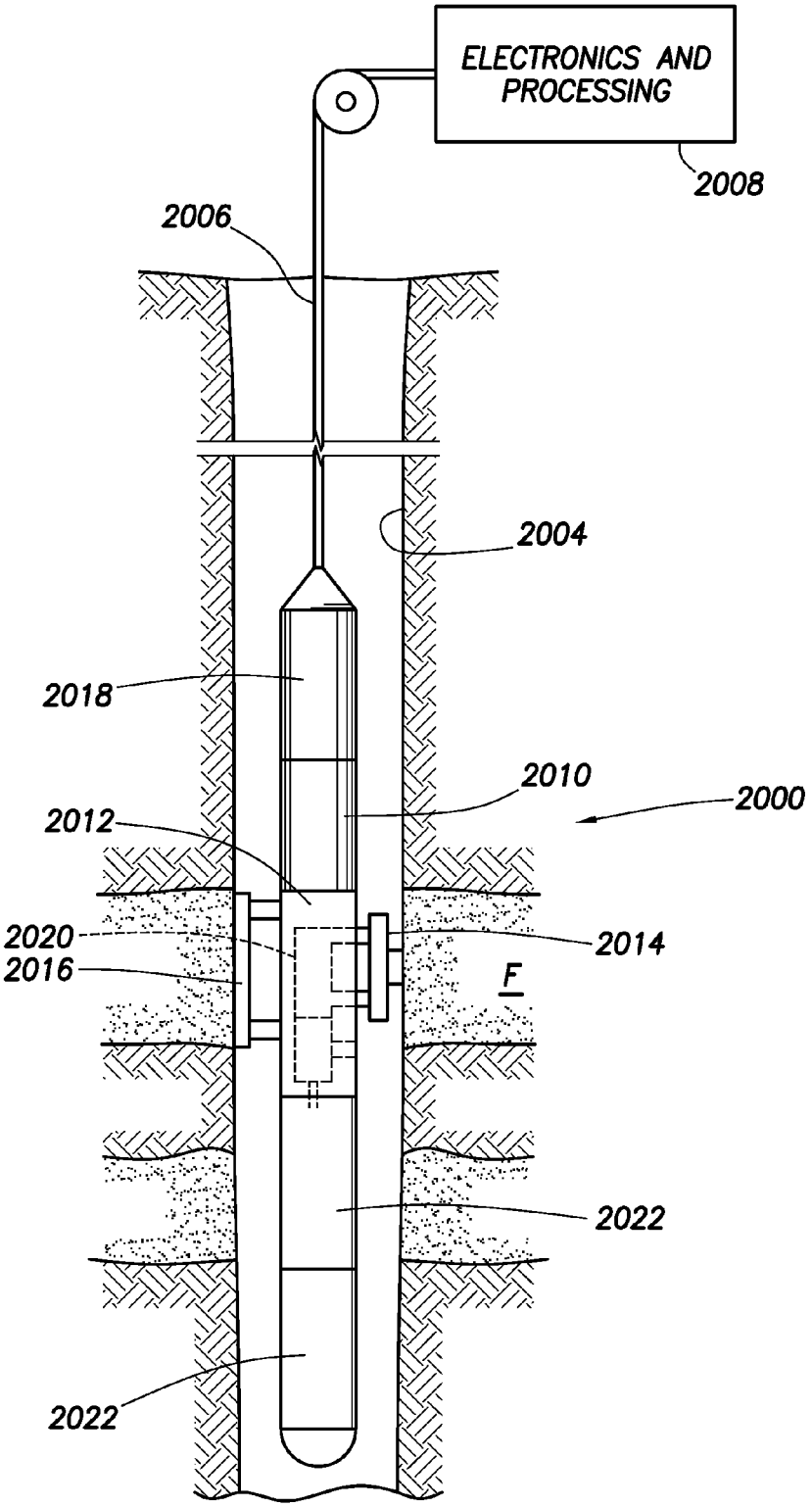
FIG. 20 is a schematic view of apparatus according to one or more aspects of the present disclosure.

Referring to FIG. 20, illustrated is a side view of a tool 2000 in accordance with one or more aspects of the present disclosure. The tool 2000 may be a "wireline" tool, in which the tool 2000 may be suspended within a wellbore 2004 formed within a subterranean formation F. As such, the tool 2000 may be suspended from an end of a multi-conductor cable 2006 located at the surface of the formation F, such as by having the multi-conductor cable 2006 spooled around a winch (not shown) disposed on the surface of the formation F. The multi-conductor cable 2006 is then coupled the tool 2000 with an electronics and processing system 2008 disposed on the surface.

The tool 2000 may have an elongated body 2010 that includes a formation tester 2012 disposed therein. The formation tester 2012 may include an extendable probe 2014 and an extendable anchoring member 2016, in which the probe 2014 and anchoring member 2016 may be disposed on opposite sides of the body 2010. One or more other components 2018, such as a measuring device, may also be included within the tool 2000.

The probe 2014 may be included within the tool 2000 such that the probe 2014 may be able to extend from the body 2010 and then selectively seal off and/or isolate selected portions of the wall of the wellbore 2004. This may enable the probe 2014 to establish pressure and/or fluid communication with the formation F to draw fluid samples from the formation F. The tool 2000 may also include a fluid analysis tester 2020 that is in fluid communication with the probe 2014, thereby enabling the fluid analysis tester 2020 to measure one or more properties of the fluid. The fluid from the probe 2014 may also be sent to one or more sample chambers or bottles 2022, which may receive and retain fluids obtained from the formation F for subsequent testing after being received at the surface. The fluid from the probe 2014 may also be sent back out into the wellbore 2004 or formation F.

Figure 21:
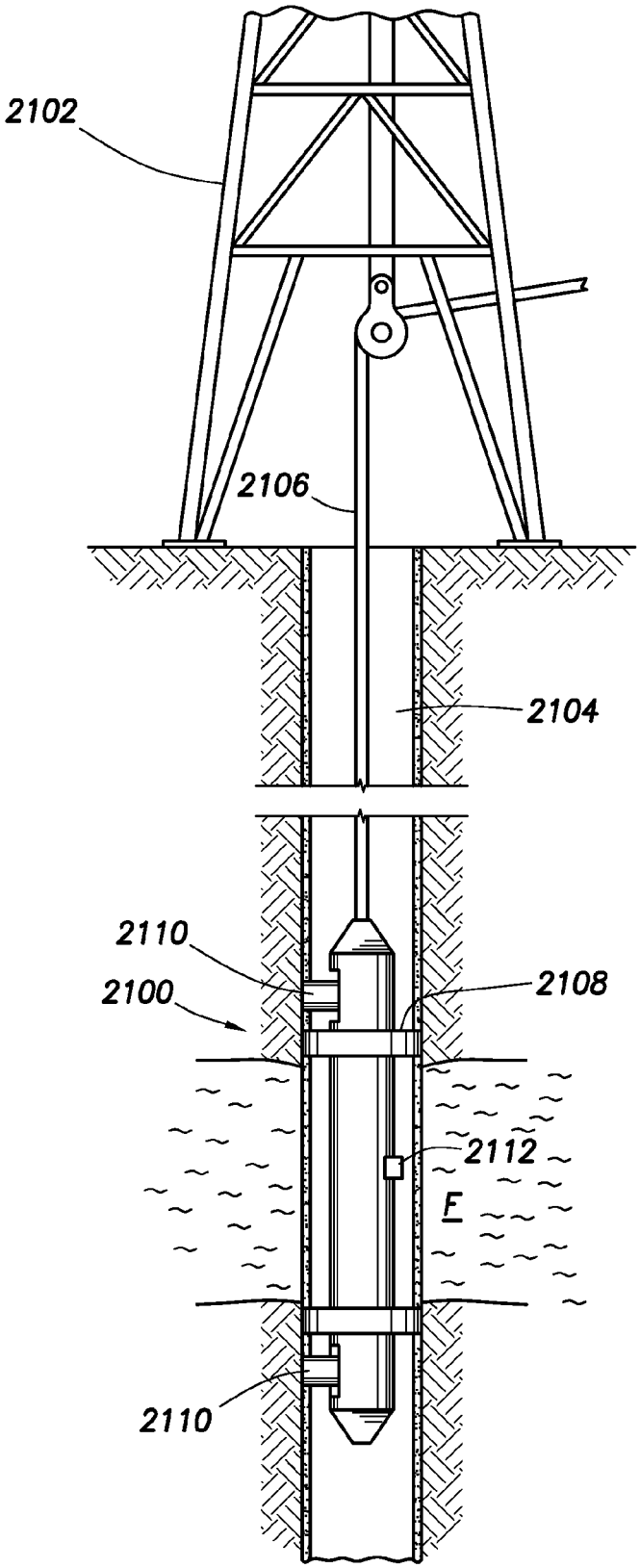
FIG. 21 is a schematic view of apparatus according to one or more aspects of the present disclosure.

Referring to FIG. 21, illustrated is a side view of another tool 2100 in accordance with one or more aspects of the present disclosure. The tool 2100 may be suspended within a wellbore 2104 formed within a subterranean formation F using a multi-conductor cable 2106. The multi-conductor cable 2106 may be supported by a drilling rig 2102.

The tool 2100 may include one or more packers 2108 that may be configured to inflate, thereby selectively sealing off a portion of the wellbore 2104 for the tool 2100. To test the formation F, the tool 2100 may include one or more probes 2110, and the tool 2100 may also include one or more outlets 2112 that may be used to inject fluids within the sealed portion established by the packers 2108 between the tool 2100 and the formation F.

Accordingly, an apparatus as described in FIGS. 2-16 may be employed in downhole tools as described in FIGS. 17-21 or any other wireline or while-drilling downhole tools within the scope of the present disclosure.

In view of all of the above and the figures, those skilled in the art should readily recognize that the present disclosure introduces an apparatus comprising: a tool body configured to be disposed within a borehole, the borehole extending into a subterranean formation; and a probe assembly movably attached to the tool body, the probe assembly comprising: an inner sealing element and an outer sealing element, wherein at least one of the inner sealing element and the outer sealing element comprises an elongated shape. The apparatus may further comprise a sample flow inlet configured to receive fluid from within the inner sealing element; and a guard flow inlet configured to receive fluid from between the inner sealing element and the outer sealing element. The sample flow inlet may comprise a piston having a filter disposed adjacent to the piston. The apparatus may further comprise a first flow line fluidly coupled to the sample flow inlet; and a second flow line fluidly coupled to the guard flow inlet. The probe assembly may be movably attached to the tool body using at least one actuator. The at least one actuator may comprise at least one of a hydraulic actuator, a pneumatic actuator, a mechanical actuator, and an electrical actuator. The at least one actuator may comprise a piston. The inner sealing element may be configured to move with respect to the outer sealing element. The inner sealing element may be disposed on an inner support, and the outer sealing element may be disposed on an outer support. The sample flow inlet may be formed in the inner support, and wherein the guard flow inlet may be formed in the outer support. The apparatus may further comprise a first actuator coupled to the inner support and a second actuator coupled to the outer support, wherein the inner support may be configured to move with respect to the outer support. The first actuator may comprise a first piston, and the second actuator may comprise a second piston. The apparatus may further comprise a packer attached to the tool body, wherein at least a portion of the probe assembly may be disposed upon the packer. The inner sealing element may be disposed on an inner support attached to the packer, and the outer sealing element may be disposed on the packer. The packer may comprise an inflatable packer.

The present disclosure also introduces a method comprising: providing a tool body, the tool body configured to be disposed within a borehole, the wellbore extending into a subterranean formation; and movably attaching a probe assembly to the tool body, the probe assembly comprising an inner sealing element and an outer sealing element, wherein at least one of the inner sealing element and the outer sealing element comprises an elongated shape. The method may further comprise providing a sample flow inlet within the probe assembly, wherein the sample flow inlet is configured to receive fluid from within the inner sealing element; and providing a guard flow inlet within the probe assembly, wherein the guard flow inlet is configured to receive fluid from between within the inner sealing element and the outer sealing element. The method may further comprise fluidly coupling a first flow line to the sample flow inlet; and fluidly coupling a second flow line to the guard flow inlet. The probe assembly may be movably attached to the tool body using at least one actuator. The at least one actuator may comprise a piston. The inner sealing element may be configured to move with respect to the outer sealing element. The method may further comprise disposing the inner sealing element on an inner support; and disposing the outer sealing element on an outer support. The method may further comprise coupling a first actuator to the inner support; and coupling a second actuator to the outer support. The method may further comprise disposing the inner sealing element on a support; and disposing the outer sealing element on a packer.

The present disclosure also introduces an apparatus comprising: a tool body configured to be conveyed within a wellbore extending into a subterranean formation; an inflatable packer coupled to the tool body; and a probe assembly coupled to the tool body and comprising an inner sealing element and an outer sealing element, wherein at least one of the inner sealing element and the outer sealing element comprises an elongated shape, and wherein at least a portion of the probe assembly is disposed on the inflatable packer. The inner sealing element may be disposed on an inner support attached to the inflatable packer, and the outer sealing element may be disposed directly on the inflatable packer. The apparatus may further comprise: a sample flow inlet configured to receive fluid from within the inner sealing element; and a guard flow inlet configured to receive fluid from between the inner sealing element and the outer sealing element. The sample flow inlet may comprise a piston having a filter disposed adjacent to the piston. The apparatus may further comprise: a first flow line fluidly coupled to the sample flow inlet; and a second flow line fluidly coupled to the guard flow inlet. The tool body may be coupled to a downhole tool configured for conveyance within the wellbore via a wireline or a drill string.

The present disclosure also introduces a method comprising: conveying a downhole tool within a wellbore extending into a subterranean formation, wherein the downhole tool comprises: an inflatable packer coupled to a tool body; and a probe assembly coupled to the tool body and comprising an inner sealing element and an outer sealing element, wherein at least one of the inner sealing element and the outer sealing element comprises an elongated shape, wherein the inner sealing element at least partially defines a sample inlet, wherein the inner and outer sealing elements collectively at least partially define a guard inlet, and wherein at least a portion of the probe assembly is disposed on the inflatable packer; establishing fluid communication between a sidewall of the wellbore and the inner and outer sealing elements of the probe assembly by inflating the inflatable packer; and drawing formation fluid from the formation into downhole tool through the guard and sample inlets. The inner sealing element may be disposed on an inner support attached to the inflatable packer, and the outer sealing element may be disposed directly on the inflatable packer. The sample inlet may comprise a piston having a filter disposed adjacent to the piston, and the method may further comprise actuating the piston to clear the filter. Conveying the downhole tool within the wellbore may comprise conveying the downhole tool via a wireline or a drill string.

The present disclosure also introduces an apparatus comprising: a tool body configured to be conveyed within a wellbore extending into a subterranean formation; and a probe assembly coupled to the tool body and comprising an inner sealing element and an outer sealing element, wherein the outer sealing element has a length of about 10 in (25.4 cm) and a width of about 5 in (12.7 cm), and wherein the inner sealing element has a length of about 8.1 in (20.6 cm) and a width of about 2.8 in (7.1 cm). A guard flow path defined between the inner and outer sealing elements may have a length of about 8.8 in (22.4 cm) and a width of about 3.6 in (9.2 cm). A sample flow path defined by the inner sealing element may have a length of about 6.8 in (17.3 cm) and a width of about 1.6 in (4.0 cm). The sample flow path and the guard flow path collectively may have an area of about 19.8 $in^2$ (127.7 $cm^2$). The sample flow path may have an area of about 10.7 $in^2$ (69.0 $cm^2$). The probe assembly may have a production rate ratio of about 1 to 2.1 between the sample flow path and the guard flow path. The apparatus may further comprise an inflatable packer coupled to the tool body, wherein the inner sealing element is disposed on an inner support attached to the inflatable packer, and wherein the outer sealing element is disposed directly on the inflatable packer. The tool body may be coupled to a downhole tool configured for conveyance within the wellbore via one of a wireline and a drill string.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a tool body configured to be conveyed within a wellbore extending into a subterranean formation;

an inflatable packer coupled to the tool body; and a probe assembly coupled to the tool body and comprising an inner sealing element and an outer sealing element, wherein at least one of the inner sealing element and the outer sealing element comprises an elongated shape, and wherein at least a portion of the probe assembly is disposed on the inflatable packer wherein the inner sealing element and the outer sealing element are mounted on an exterior surface of the inflatable packer;

a sample flow inlet configured to receive fluid from within the inner sealing element; and a guard flow inlet configured to receive fluid from between the inner sealing element and the outer sealing element wherein the inner sealing element and the outer sealing element are movable with respect to each other.

2. The apparatus of claim 1 wherein the inner sealing element is disposed on an inner support attached to the inflatable packer, and wherein the outer sealing element is disposed directly on the inflatable packer.

3. The apparatus of claim 1 wherein the sample flow inlet comprises a piston having a filter disposed adjacent to the piston.

4. The apparatus of claim 1 further comprising:

a first flow line fluidly coupled to the sample flow inlet; and a second flow line fluidly coupled to the guard flow inlet.

5. The apparatus of claim 1 wherein the tool body is coupled to a downhole tool configured for conveyance within the wellbore via a wireline.

6. The apparatus of claim 1 wherein the tool body is coupled to a downhole tool configured for conveyance within the wellbore via a drill string.

7. A method, comprising:

conveying a downhole tool within a wellbore extending into a subterranean formation, wherein the downhole tool comprises:

an inflatable packer coupled to a tool body; and a probe assembly coupled to the tool body and comprising an inner sealing element and an outer sealing element, wherein at least one of the inner sealing element and the outer sealing element comprises an elongated shape, wherein the inner sealing element at least partially defines a sample inlet, wherein the inner and outer sealing elements collectively at least partially define a guard inlet, and wherein at least a portion of the probe assembly is disposed on the inflatable packer and wherein the inner sealing element and the outer sealing element are mounted on an exterior surface of the inflatable packer wherein the inner sealing element and the outer sealing element are movable with respect to each other;

establishing fluid communication between a sidewall of the wellbore and the inner and outer sealing elements of the probe assembly by inflating the inflatable packer; and drawing formation fluid from the formation into downhole tool through the guard and sample inlets.

8. The method of claim 7 wherein the inner sealing element is disposed on an inner support attached to the inflatable packer, and wherein the outer sealing element is disposed directly on the inflatable packer.

9. The method of claim 7 wherein the sample inlet comprises a piston having a filter disposed adjacent to the piston, and wherein the method further comprises actuating the piston to clear the filter.

10. The method of claim 7 wherein conveying the downhole tool within the wellbore comprises conveying the downhole tool via a wireline.

11. The method of claim 7 wherein conveying the downhole tool within the wellbore comprises conveying the downhole tool via a drill string.

12. An apparatus, comprising:

a tool body configured to be conveyed within a wellbore extending into a subterranean formation; and a probe assembly coupled to the tool body and comprising an inner sealing element and an outer sealing element, wherein the outer sealing element has a length of about 10 in (25.4 cm) and a width of about 5 in (12.7 cm), and wherein the inner sealing element has a length of about 8.1 in (20.6 cm) and a width of about 2.8 in (7.1 cm) and wherein the inner sealing element and the outer sealing element are mounted on an exterior surface of the inflatable packer wherein the inner sealing element and the outer sealing element are movable with respect to each other.

13. The apparatus of claim 12 wherein a guard flow path defined between the inner and outer sealing elements has a length of about 8.8 in (22.4 cm) and a width of about 3.6 in (9.2 cm).

14. The apparatus of claim 13 wherein a sample flow path defined by the inner sealing element has a length of about 6.8 in (17.3 cm) and a width of about 1.6 in (4.0 cm).

15. The apparatus of claim 14 wherein the sample flow path and the guard flow path collectively have an area of about 19.8 $in^2$ (127.7 $cm^2$).

16. The apparatus of claim 15 wherein the sample flow path has an area of about 10.7 $in^2$ (69.0 $cm^2$).

17. The apparatus of claim 16 wherein the probe assembly has a production rate ratio of about 1 to 2.1 between the sample flow path and the guard flow path.

18. The apparatus of claim 12 further comprising an inflatable packer coupled to the tool body, wherein the inner sealing element is disposed on an inner support attached to the inflatable packer, and wherein the outer sealing element is disposed directly on the inflatable packer.

19. The apparatus of claim 12 wherein the tool body is coupled to a downhole tool configured for conveyance within the wellbore via one of a wireline and a drill string.

* * * * *